US007140177B2

(12) United States Patent
Koyama et al.

(10) Patent No.: US 7,140,177 B2
(45) Date of Patent: Nov. 28, 2006

(54) SECONDARY AIR SUPPLY SYSTEM AND ABNORMALITY DIAGNOSIS METHOD OF SECONDARY AIR SUPPLY SYSTEM

(75) Inventors: Hiroyasu Koyama, Mishima (JP); Yasuhiro Oi, Numazu (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 44 days.

(21) Appl. No.: 11/000,394

(22) Filed: Dec. 1, 2004

(65) Prior Publication Data

US 2005/0120711 A1 Jun. 9, 2005

(30) Foreign Application Priority Data

Dec. 4, 2003 (JP) ..... 2003-405986
Dec. 4, 2003 (JP) ..... 2003-406110

(51) Int. Cl.
*F01N 3/00* (2006.01)

(52) U.S. Cl. ..... 60/289; 60/274; 60/277; 60/290; 60/291; 60/292; 60/293; 60/304; 60/305

(58) Field of Classification Search ..... 60/274, 60/277, 285, 287, 289, 290, 291, 292, 293, 60/304, 305
See application file for complete search history.

(56) References Cited

U.S. PATENT DOCUMENTS 5,381,658 A * 1/1995 Meguro ..... 60/276
5,444,978 A * 8/1995 Yoshizaki et al. ..... 60/276
5,499,502 A * 3/1996 Haniu et al. ..... 60/290
5,852,929 A * 12/1998 Kato et al. ..... 60/274
6,918,245 B1 * 7/2005 Hirooka et al. ..... 60/289
6,973,777 B1 * 12/2005 Bayerle et al. ..... 60/289

FOREIGN PATENT DOCUMENTS

JP 05-86848 A 4/1993
JP 2003-83048 A 3/2003
JP 34444548 B2 6/2003
JP 2005351198 A * 6/2004 ..... 60/289
JP 02005163722 A * 6/2005 ..... 60/289

* cited by examiner

*Primary Examiner*—Binh Q. Tran
(74) *Attorney, Agent, or Firm*—Oliff & Berridge, PLC

(57) ABSTRACT

In a secondary air supply system, each of two branch portions of a secondary air supply pipe that is divided from a joint portion is provided with an air control valve, and the joint portion is provided with a pressure sensor and an auxiliary air control valve. The air control valves are opened at different timings such that pressure fluctuations in the joint portion upon opening of the firstly and the secondly opened air control valves are measured. An abnormality diagnosis is performed with respect to those two air control valves based on combinations of the aforementioned two pressure fluctuations.

24 Claims, 18 Drawing Sheets

SECONDARY AIR SUPPLY SYSTEM AND ABNORMALITY DIAGNOSIS METHOD OF SECONDARY AIR SUPPLY SYSTEM

INCORPORATION BY REFERENCE

The disclosure of Japanese Patent Applications No. 2003-406110 filed on Dec. 4, 2003, and No. 2003-405986 filed on Dec. 4, 2003, each including the specification, drawings and abstract are incorporated herein by reference in their entirety.

BACKGROUND OF THE INVENTION

1. Field of Invention

The invention relates to a secondary air supply system and, more particularly, to a secondary air supply system including a secondary air supply pipe that is divided into two branch portions each having an air control valve and being connected to each of two exhaust systems of an internal combustion engine with two banks. The invention relates to a secondary air supply system that supplies secondary air to a section upstream of an exhaust emission control device provided in an exhaust passage of the internal combustion engine for detecting an abnormality in components of the secondary air supply system.

2. Description of Related Art

Generally a catalyst is employed for purifying exhaust gas discharged from the internal combustion engine. The catalytic temperature has to be raised from the low-temperature state as quickly as possible upon start-up so as to improve the purifying rate. The catalyst is activated upon increase in the oxygen concentration of the exhaust gas to raise the catalytic temperature. In the aforementioned case, a secondary air supply system is employed to supply air into the exhaust gas so as to be mixed for raising the catalytic temperature. The aforementioned secondary air supply system supplies air from an air pump into the exhaust pipe via a secondary air supply pipe connected thereto.

The catalyst is not activated at an appropriate timing unless secondary air can be supplied when needed. If, however, the secondary air is supplied in a state where the catalyst has been already activated at sufficiently high temperature, the catalyst may be excessively heated. Then the secondary air supply pipe is provided with an air control valve that controls supply of the secondary air such that appropriate quantity of secondary air is supplied to the exhaust pipe.

If the air control valve has an abnormality, appropriate quantity of secondary air cannot be supplied, causing either deterioration in exhaust emission or excessive heating of the catalyst. For example, JP-A-2003-83048 discloses the secondary air supply system that allows diagnosis of abnormality in the air control valve. In the aforementioned system, a pressure sensor is provided between the air control valve and the air pump so as to detect the abnormality in the air control valve based on fluctuation of the pressure detected by the pressure sensor upon operation of the air control valve.

There is an internal combustion engine having a plurality of banks of, for example, two cylinder groups each including a plurality of cylinders like a V-type engine, and each of the banks is provided with an exhaust pipe. In the case where secondary air is supplied to the respective exhaust pipes of the V-type engine, it is possible to supply secondary air to the respective exhaust pipes independently. In this case, however, two air pumps are required, resulting in the cost increase.

In the apparatus disclosed in JP-A-5-86848, secondary air is supplied to two exhaust valves via two branch portions of the secondary air supply pipe from its joint portion. The air control valve is provided for each of the branch portions of the secondary air supply pipe. In this case, the two branch portions of the secondary air supply pipe join at upstream side, and each secondary air flowing through the respective branch portions may influence with each other.

The secondary air supply system that allows abnormality diagnosis of two air control valves accurately at low costs has never been developed (see JP-A-2003-83048).

In the known exhaust emission control device of the internal combustion engine, the catalyst that exhibits oxidizing function is provided within the exhaust passage so as to purify the exhaust gas by reducing the content of the exhaust gas, that is, carbon monoxide (CO), hydrocarbon (HC), and nitrogen oxide ($NO_X$). There is a known secondary air supply apparatus in which air is supplied under pressure from the air pump to a secondary air supply passage having a valve connected to the exhaust passage for supplying secondary air into the exhaust pipe so as to increase oxygen concentration. Then HC, CO contained within the exhaust gas are oxidized to improve purification of the exhaust gas. In the aforementioned secondary air supply apparatus, in the case where abnormality is detected in components such as the air pump or the air control valves, the exhaust gas purification rate may be decreased to deteriorate emission. Therefore, the pressure sensor is provided in the secondary air supply passage so as to detect the abnormality in the components based on the pressure value detected by the pressure sensor (see JP-3444458).

If the internal combustion engine includes two banks as aforementioned, the exhaust emission control device is provided for each bank so as to purify the exhaust gas by oxidizing HC and CO contained within the exhaust gas in the exhaust passage from the respective banks. Then the secondary air supply pipe of the secondary air supply system is divided into two branch portions. In this case, an auxiliary air control valve is provided for a joint portion of the secondary air supply pipe upstream of the branch portions, and two air control valves are provided for the respective branch portions.

FIG. 19 shows a timing chart representing an operation of the aforementioned secondary air supply system and a graph representing a relationship between time and pressure with respect to the operation of the secondary air supply system. When the air pump provided on the joint portion of the secondary air supply pipe is driven and the auxiliary air control valve at the upstream side is opened after a predetermined elapse of time, the pressure P within the secondary air supply pipe increases up to P0. When the air control valve provided in one of the branch portions is opened after a predetermined elapse of time, the pressure P is reduced to the pressure P1. When the other air control valve provided in the other branch portion is opened after a predetermined elapse of time, the pressure P is reduced to P2. Then secondary air is supplied to the section of the exhaust passage upstream of the exhaust emission control device. The pressure Pon upon supply of the secondary air is measured for a time period TPon. After measuring the pressure Pon, the pump is stopped, and the firstly and the secondly opened air control valves at the downstream side are closed simultaneously. Then supply of secondary air is stopped. Pressure Poff in the state where secondary air is not supplied after a predetermined elapse of time is measured for a time period TPoff. The auxiliary air control valve, then is closed.

Then it is determined whether there is an abnormality in the components of the secondary air supply system based on the pressure difference ΔP1 between the pressure detected upon opening of the auxiliary air control valve and the pressure detected upon opening of the first air control valve (firstly opened air control valve), that is, (P0−P1), the pressure difference ΔP2 between the pressure detected upon opening of the first air control valve and the (secondly opened air control valve) pressure detected upon opening of the second air control valve, that is, (P1−P2), and the pressure Poff measured upon stop of the secondary air supply system.

As shown in FIG. 19, as the pressure difference ΔP1 upon opening of the first air control valve at the downstream side after opening the auxiliary air control valve at the upstream side is relatively large, the abnormality in the component may be easily detected. Meanwhile as the pressure difference ΔP2 upon opening of the first air control valve and then the second air control valve is relatively small, it is further difficult to determine the abnormality in the component, for example, the second air control valve based on the pressure difference ΔP2 compared with the abnormality diagnosis with respect to other components.

The secondary air is supplied to the exhaust system in the internal combustion engine through the joint portion and the respective branch portions of the secondary air supply pipe upon activation of the air pump. The discharging performance of the pipe may be deteriorated owing to aging for an extended service period. In case of deterioration in the performance of the pump, the pressure P0 after opening of the auxiliary air control valve by driving the air pump is decreased. Each of the pressure differences ΔP1 and ΔP2 is decreased accordingly. It may further be difficult to determine the abnormality in the component, especially the second air control valve based on the pressure differences ΔP1, ΔP2.

SUMMARY OF THE INVENTION

A secondary air supply system according to the invention is provided with a secondary air supply pipe divided into two branch portions for two exhaust systems in the internal combustion engine including two banks, and an air control valve is provided for each of the respective branch portions of the secondary air supply pipe. The secondary air supply system allows accurate diagnosis with respect to abnormality in those two air control valves at low costs.

According to a first aspect of the invention, a secondary air supply system supplies secondary air to each of exhaust pipes attached to each of two banks of an internal combustion engine via a secondary air supply pipe including a joint portion and two branch portions divided from the joint portion. The secondary air supply system includes two air control valves respectively provided in the two branch portions, and a pressure sensor provided in the joint portion of the secondary air supply pipe. An abnormality diagnosis is executed with respect to the two air control valves, that is, a first air control valve that is firstly opened and a second air control valve that is secondly opened, which are opened at different timings based on a combination of a fluctuation of a pressure in the joint portion detected by the pressure sensor upon opening of the first air control valve and a fluctuation of a pressure in the joint portion detected by the pressure sensor upon opening of the second air control valve.

According to another aspect of the invention, an abnormality diagnosis method of a secondary air supply system is provided. The secondary air supply system supplies secondary air to each of exhaust pipes attached to each of two banks of an internal combustion engine via a secondary air supply pipe including a joint portion and two branch portions divided from the joint portion. The secondary air supply system further includes two air control valves respectively provided in the two branch portions, and a pressure sensor provided in the joint portion of the secondary air supply pipe. In the abnormality diagnosis method, an abnormality diagnosis is executed with respect to the two air control valves which are opened at different timings, the two air control valves including a first air control valve that is firstly opened and a second air control valve that is secondly opened, based on a combination of a fluctuation of a pressure in the joint portion detected by the pressure sensor upon opening of the first air control valves and a fluctuation of a pressure in the joint portion detected by the pressure sensor upon opening of the second air control valve.

In the secondary air supply system as structured above and the abnormality diagnosis method of the secondary air supply system, each of the air control valves provided for the branch portion of the secondary air supply pipe is opened at different timings. Then, the abnormality in one of those two air control valves is diagnosed based on the combination of pressure fluctuations in the joint portion of the secondary air supply pipe, which are detected by the pressure sensor at the respective timings.

DETAILED DESCRIPTION OF PREFERRED EMBODIMENTS

Figure 1:
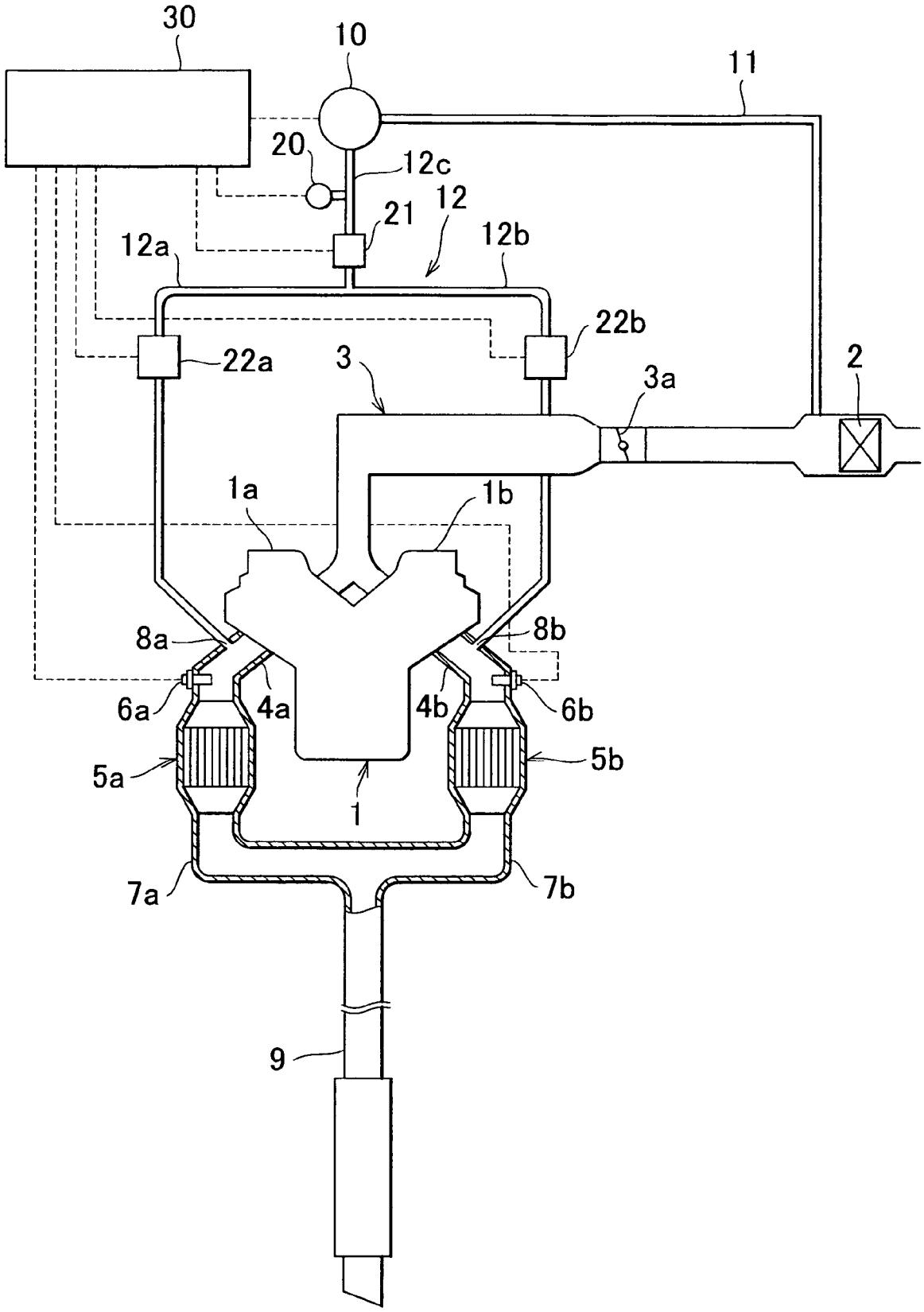
FIG. 1 is a schematic view of a structure of a secondary air supply system according to a first aspect of the invention.

The respective embodiments and modified examples according to the invention will be described referring to the drawings.

Referring to FIG. 1, a general structure of the aforementioned embodiments will be explained.

In FIG. 1, cylinders of a V-type engine 1 having two banks 1*a*, 1*b* are divided into two cylinder groups. An intake pipe 3 is attached to the engine 1, and an air cleaner 2 is provided at an inlet of the intake pipe 3.

Exhaust manifolds 4*a*, 4*b* are attached to the banks 1*a*, 1*b*, respectively. Exhaust pipes 7*a*, 7*b* are connected to the exhaust manifolds 4*a*, 4*b*, respectively. Catalytic converters 5*a*, 5*b* each carrying three-way catalyst are provided within the exhaust pipes 7*a*, 7*b*, respectively such that HC, CO, and $NO_X$ contained in the exhaust gas are removed. $O_2$ sensors 6*a*, 6*b* are attached on the exhaust pipes 7*a*, 7*b* upstream of the catalytic converters 5*a*, 5*b*, respectively each for detecting oxygen concentration. The exhaust gas purified through the catalytic converters 5*a*, 5*b* flows through an exhaust pipe 9 so as to be discharged.

Secondary air inlets 8*a*, 8*b* are formed in the exhaust pipes 7*a*, 7*b*, and connected to the respective lower ends of branch portions 12*a*, 12*b* of a secondary air supply pipe 12. The branch portions 12*a*, 12*b* join at an upstream end, and connected to a joint portion 12*c* of the secondary air supply pipe 12. The upper end of the joint portion 12*c* of the secondary air supply pipe 12 is connected to an outlet of an air pump 10. An inlet of the air pump 10 is connected to an air cleaner 2 via an intake air pipe 11.

A pressure sensor 20 and an auxiliary air control valve 21 downstream thereof are provided on the joint portion 12*c* of the secondary air supply pipe 12. Air control valves 22*a*, 22*b* are provided in the branch portions 12*a*, 12*b*, respectively. In the embodiment of the invention, the auxiliary air control valve 21 serves to prevent the pressure sensor 20, the air pump 10 and the like from being damaged by the back-flow of the exhaust gas through at least one of the air control valves 22*a*, 22*b* that may be left opened during high-load operation.

An electronic control unit (ECU) 30 is formed as a micro-computer including a back-up RAM that maintains data after turning the power off. The ECU 30, connected to the pressure sensor 20, the auxiliary air control valve 21, the air control valves 22*a*, 22*b*, and the like, serves to perform abnormality diagnosis as described below and various types of control as well.

The control for the abnormality diagnosis executed in the above-structured system will be described.

The background of the abnormality diagnosis will be explained hereinafter.

The diagnosis is basically performed by opening two air control valves, that is, 22*a* and 22*b* at different timings in one diagnostic cycle. Then presence or absence of abnormality or type of the abnormality may be diagnosed based on the pressure fluctuation that occurs upon opening of those valves.

Figure 2:
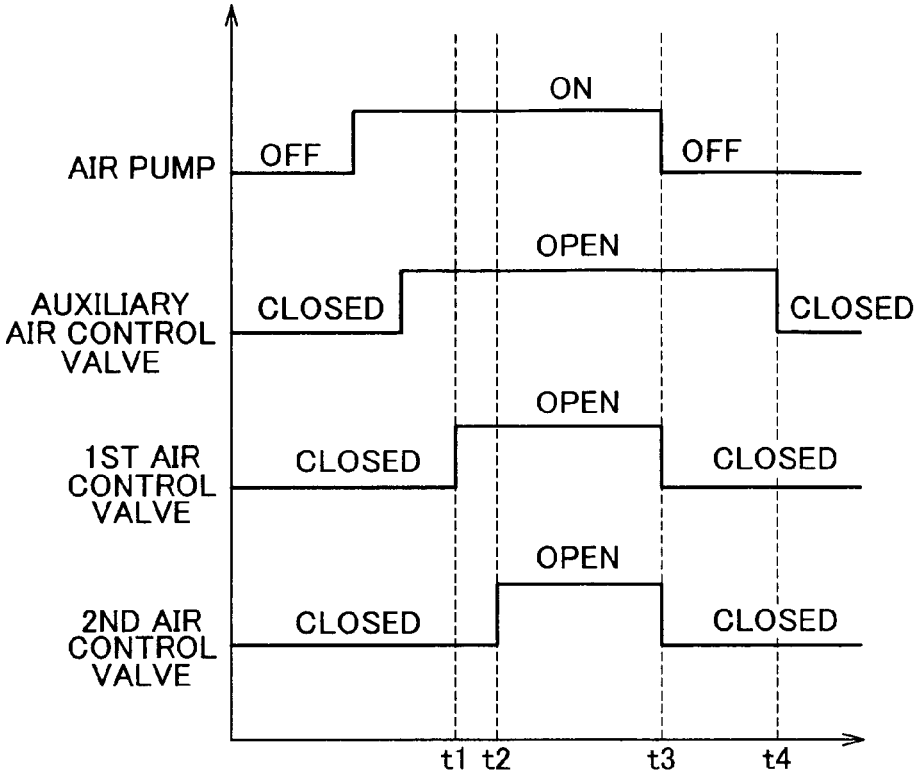
FIG. 2 shows timing charts each representing operations of an air pump, an auxiliary air control valve, a first air control valve, and a second air control valve.

FIG. 2 is a timing chart representing each operation timing of the air pump 10, the auxiliary air control valve 21, the air control valve that is opened firstly, and the air control valve that is opened secondly.

Referring to FIG. 2, the air pump 10 is turned ON first, and the auxiliary air control valve 21 is opened. One of the air control valves, that is, first air control valve is opened firstly at a timing t1, and the other air control valve, that is, second air control valve is opened secondly at a timing t2 behind the timing t1. The air pump 10 is turned OFF at a timing t3, and the firstly and the secondly opened air control valves are simultaneously closed. Then at a timing t4, the auxiliary air control valve 21 is closed.

In the embodiment as described below, the fluctuation of pressures detected by the pressure sensor 20 is measured at the time t1 and time t2, respectively, based on which the presence or absence of abnormality or the type of the abnormality are diagnosed. The magnitude of the pressure fluctuation is derived from the difference between the pressure before fluctuation and the pressure after fluctuation. Accordingly, the pressures before and after the fluctuation are calculated.

Figure 3:
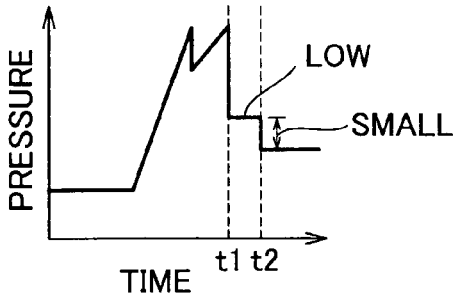
FIG. 3 is a graph showing a pressure fluctuation when the first and the second air control valves are normally operated.

FIG. 3 shows the pressure fluctuation in the joint portion of the secondary air supply pipe 12 detected by the pressure sensor 20 when the first and the second air control valves are normally operated.

When the air pump 10 is activated in the state where the auxiliary air control valve 21, the air control valves 22*a*, 22*b* are all closed, the pressure in the joint portion 12*c* of the secondary air supply pipe 12 begins rising. When the auxiliary control valve 21 is opened, each volume between the auxiliary air control valve 21 and the air control valves 22*a*, 22*b* increases, and the pressure temporarily drops. As the air control valves 22*a*, 22*b* are still held closed, the pressure begins rising again. At the time t1, one of the air control valves is opened firstly to form a passage of air, thus further dropping the pressure. At the time t2, the other air control valve is opened secondly so as to form the air passage in both the air control valves, thus further dropping the pressure.

As aforementioned, if the first and the second air control valves are normally operated, the pressure will drop when the first air control valve is opened and when the second air control valve is opened.

Figure 4A:
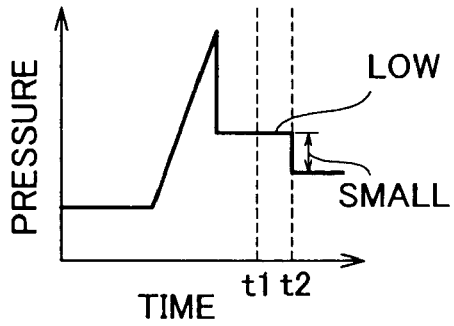
FIG. 4 shows graphs each representing a pressure fluctuation when the first air control valve has abnormality and the second air control valve is normally operated, FIG. 4A representing an open abnormality of the first air control valve (left opened), and FIG. 4B representing a close abnormality of the first air control valve (left closed)
Figure 4B:
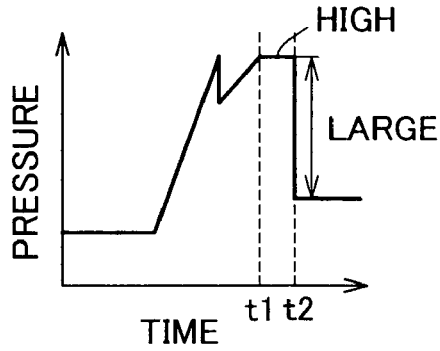

FIG. 4A shows the pressure fluctuation in the case where the second control valve is normally operated, and the first control valve has open abnormality (left opened). FIG. 4B shows the pressure fluctuation in the case where the second control valve is normally operated, and the first control valve has close abnormality (left closed). In both cases, upon opening of the first air control valve, there is no pressure fluctuation, and the pressure drops upon opening of the second air control valve. The pressure drop of the second air control valve in case of the close abnormality is larger than that in case of the open abnormality. In case of the close abnormality, the pressure drops from the value higher than that in case of the open abnormality.

Figure 5A:
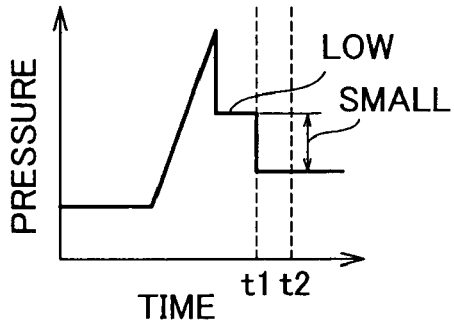
FIG. 5 shows graphs each representing a pressure fluctuation when the first air control valve is normally operated and the second air control valve has abnormality, FIG. 5A representing an open abnormality of the first air control valve (left closed), and FIG. 5B representing a close abnormality of the second air control valve (left closed)
Figure 5B:
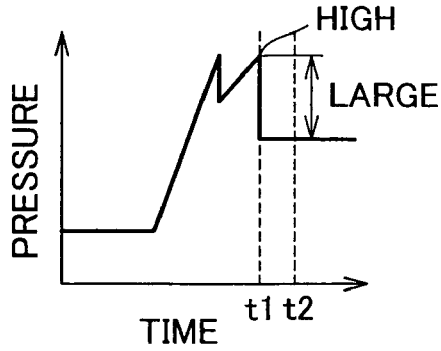

FIG. 5A shows the pressure fluctuation in the case where the first control valve is normally operated, and the second control valve has open abnormality (left opened). FIG. 5B shows the pressure fluctuation in the case where the first control valve is normally operated, and the second control valve has close abnormality (left closed). In both cases, upon opening of the first air control valve, the pressure fluctuation is observed, and no pressure fluctuation is observed upon opening of the second air control valve. The pressure drop of the first air control valve in case of the close abnormality is larger than that in case of the open abnormality. In case of the close abnormality, the pressure drops from the value higher than that in case of the open abnormality.

Figure 6A:
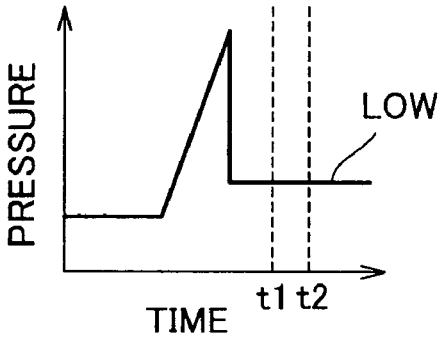
FIG. 6 shows graphs each representing a pressure fluctuation when each of the first and the second air control valves has abnormality, FIG. 6A representing each open abnormality of both the air control valves (left opened), and FIG. 6B representing each close abnormality of both the air control valves (left closed)
Figure 6B:
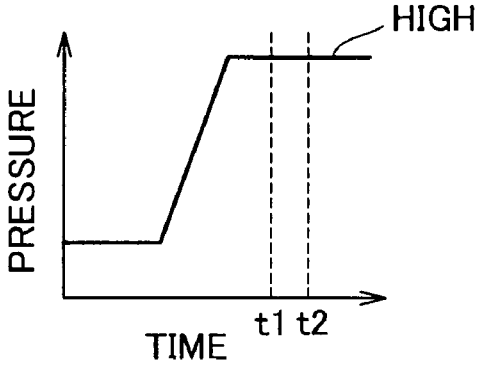

Referring to FIG. 6A, no pressure fluctuation is observed in the case where the first and the second air control valves have open abnormality (left opened). Referring to FIG. 6B, no pressure fluctuation is observed in the case where the first and the second air control valves have close abnormality (left closed). In both cases, the pressure does not fluctuate upon opening of the first nor the second air control valve. In case of the close abnormality of the first and the second air control valves, the pressure is held higher than that in case of the open abnormality (left opened).

As described above, the types of abnormality in the air control valve may be determined to be one of cases as classified below.

Case A: The first and the second air control valves are normally operated if there is the pressure fluctuation upon opening of the first air control valve, and there is also the pressure fluctuation upon opening of the second air control valve.

Case B: The first air control valve has abnormality if there is no pressure fluctuation upon opening of the first air control valve, and there is pressure fluctuation upon opening of the second air control valve.

Case B1: The aforementioned abnormality is caused by the state where the first air control valve cannot be closed or held opened if the pressure fluctuation upon opening of the second air control valve is small or the pressure drops from the lower pressure value.

Case B2: The aforementioned abnormality is caused by the state where the first air control valve cannot be opened or held closed if the pressure fluctuation upon opening of the second air control valve is large or the pressure drops from the higher pressure value.

Case C: The second air control valve has abnormality if there is pressure fluctuation upon opening of the first air control valve, and there is no pressure fluctuation upon opening of the second air control valve.

Case C1: The aforementioned abnormality is caused by the state where the second air control valve cannot be closed or left opened if the pressure fluctuation upon opening of the first air control valve is small or the pressure drops from the lower pressure value.

Case C2: The aforementioned abnormality is caused by the state where the second air control valve cannot be opened or left closed if the pressure fluctuation upon opening of the first air control valve is large or the pressure drops from the higher pressure value.

Case D: Both the first and the second air control valves have abnormality if there is no pressure fluctuation upon opening of the first and the second air control valves.

Case D1: The aforementioned abnormality is caused by the state where both the first and the second air control valves cannot be closed or left opened if the pressure is held lower.

Case D2: The aforementioned abnormality is caused by the state where both the first and the second air control valves cannot be opened or left closed if the pressure is held higher.

Figure 7:
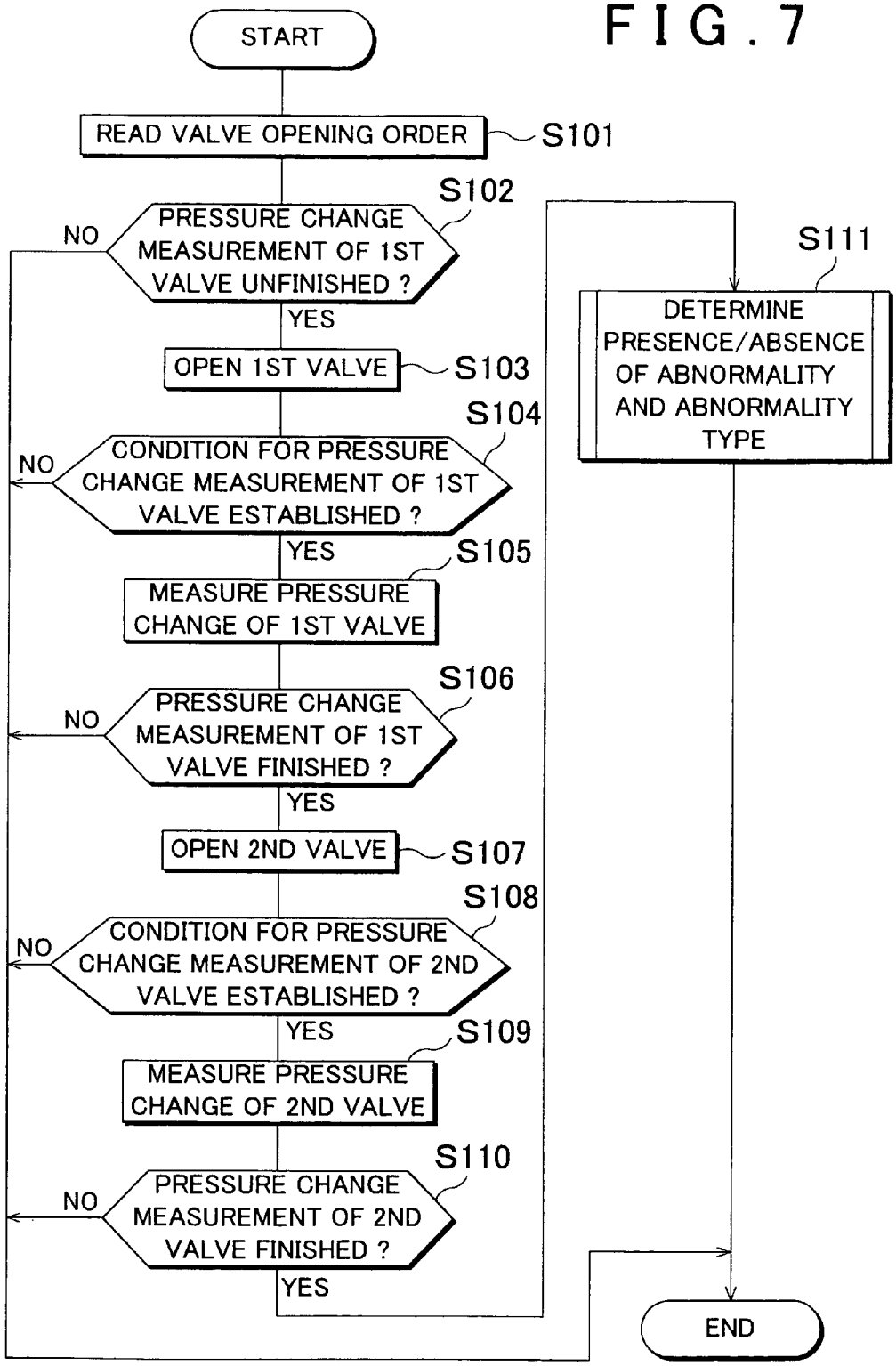
FIG. 7 is a flowchart of an abnormality diagnosis according to an embodiment of the invention.

In the first embodiment, the type of the abnormality is diagnosed by executing the control as shown in the flowchart of FIG. 7.

Each step of the control shown in the flowchart of FIG. 7 will be described.

In step S101, a valve opening order for opening the air control valves, which is stored in the RAM of the ECU 30 is read. In step S102, it is determined whether the pressure fluctuation measurement of the first air control valve has been unfinished. If Yes is obtained in step S102, the process proceeds to step S103 where the first air control valve is opened, and the process proceeds to step S104 where it is determined whether the pressure fluctuation measurement conditions for the first air control valve have been established. Such conditions include:

(1) operating conditions requiring secondary air supply:
  (1a) within a predetermined period of time from start-up;
  (1b) temperature of engine cooling water is within a predetermined temperature range;
(2) air pump 10 is in operation;
(3) auxiliary control valve 21 is opened; and
(4) air control valve to be diagnosed is opened.

When No is obtained in step S104, the control routine ends. When Yes is obtained in step S104, the process proceeds to step S105 where the pressure fluctuation of the first air control valve is measured, and the result is stored. In step S106, it is determined whether the pressure fluctuation measurement has been finished. When No is obtained in step S106, the control routine ends. When Yes is obtained in step S106, the process proceeds to step S107 where the second air control valve is opened and further proceeds to step S108. In step S108, it is determined whether conditions for the pressure fluctuation measurement for the second air control valve have been established. The conditions are the same as those described in step S104 except that the second air control valve is to be diagnosed. The same processes as those executed in steps S104 and S105 are executed with respect to the second air control valve in steps S109 and S110, and then the process proceeds to step S111. In step S111, the presence or absence of abnormality in the air control valve or the abnormality type is determined based on the measurement results of the pressure fluctuation of the first and the second air control valves, which have been stored in step S105 and step S109, respectively.

Figure 8:
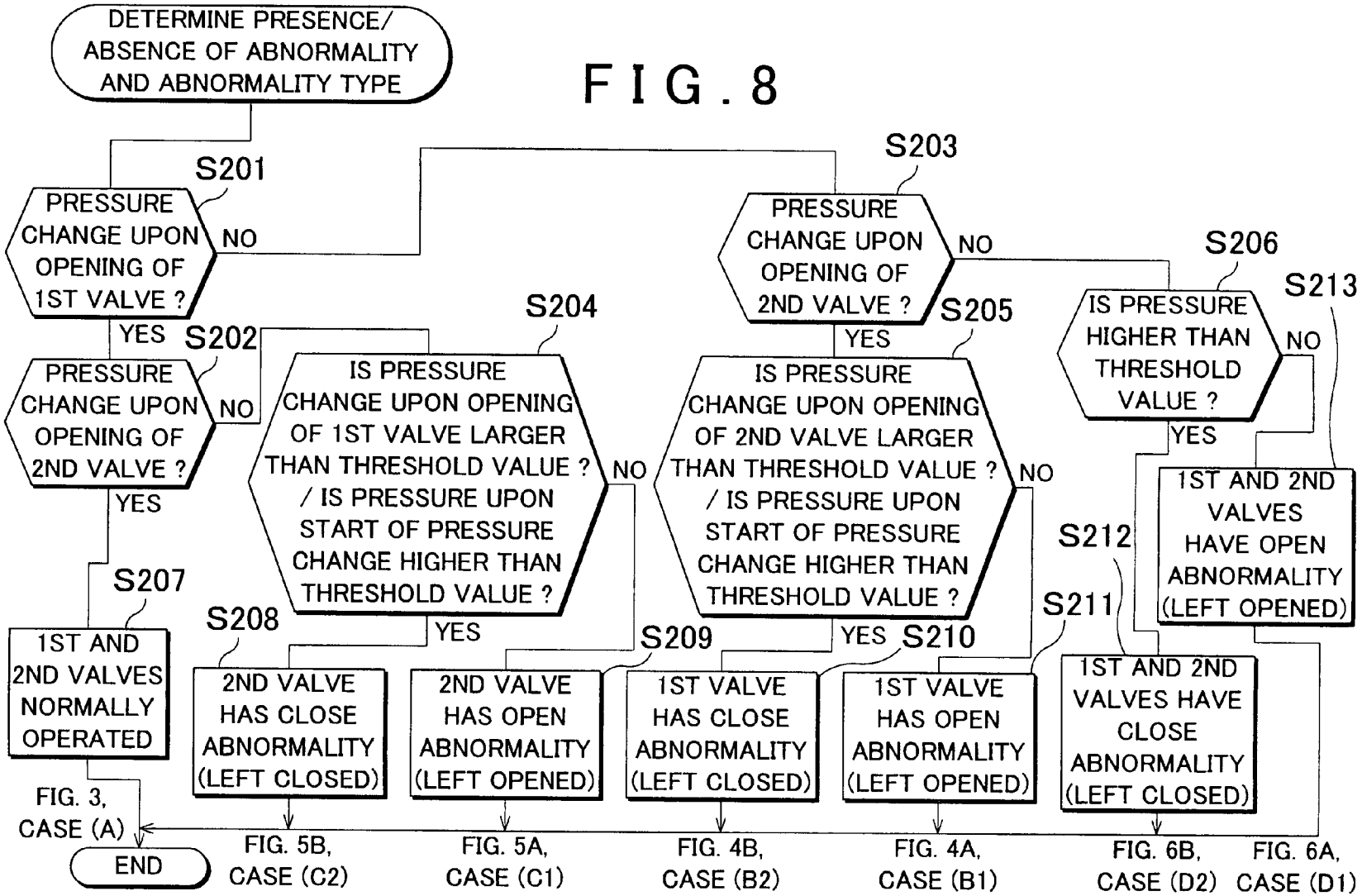
FIG. 8 is a flowchart of a sub-routine executed in step S111 of the flowchart shown in FIG. 7 for determining whether there is abnormality or a type of the abnormality.

The flowchart shown in FIG. 8 represents the sub-routine for determining presence or absence of the abnormality and the abnormality type of the air control valve, which is executed in step S111 of the flowchart shown in FIG. 7.

In step S201, it is determined whether the pressure fluctuation occurs upon opening of the first air control valve. When Yes is obtained in step S201, the process proceeds to step S202 where it is determined whether the pressure fluctuation occurs upon opening of the second air control valve. When No is obtained in step S201, the process proceeds to step S203 where it is determined whether the pressure fluctuation occurs upon opening of the second air control valve.

In the case where no pressure fluctuation occurs upon opening of the first air control valve, the process proceeds to step S203. Preferably, however, the process proceeds to step S203 after ensuring the state of no pressure fluctuation, that is, confirming that such state has continued for a predetermined period of time.

When Yes is obtained in step S202, that is, the pressure fluctuation occurs upon opening of both the first and the second air control valves as shown in FIG. 3 (Case A), the process proceeds to step S207 where it is determined that both the air control valves are normally operated. The process, then ends.

When No is obtained in step S202, the process proceeds to step S204. In the case where the pressure fluctuation occurs upon opening of the first air control valve, and no pressure fluctuation occurs upon opening of the second air control valve, the process proceeds to step S204. Preferably, however, the process proceeds to step S204 after ensuring the state of no pressure fluctuation, that is, confirming that such state has continued for a predetermined period of time.

In the case where the pressure fluctuation occurs upon opening of the first air control valve, and no pressure fluctuation occurs upon opening of the second air control valve, that is, the second air control valve has abnormality as shown in FIG. 5A or FIG. 5B (Case C1 or Case C2), the process proceeds to step S204. In this stage, however, it cannot be determined whether the abnormality is open abnormality or close abnormality. In step S204, it is determined whether the magnitude of the pressure fluctuation of the first air control valve is larger than a predetermined threshold value, or whether the pressure of the first air control valve upon start of the pressure fluctuation is larger than a predetermined threshold value.

When Yes is obtained in step S204, the abnormality is determined as the case C2 as shown in FIG. 5B. The process then proceeds to step S208 where it is determined that the second air control valve has close abnormality (left closed), and the routine ends.

When No is obtained in step S204, the abnormality is determined as the case C1 as shown in FIG. 5A. The process then proceeds to step S209 where it is determined that the second air control valve has open abnormality (left opened), and the routine ends.

When No is obtained in step S201 and the process proceeds to step S203, it is determined whether the pressure fluctuation occurs upon opening of the second air control valve in the same manner as in step S202. When Yes is obtained in step S203, the process proceeds to step S205. When No is obtained in step S203, the process proceeds to step S206. In the case where no pressure fluctuation occurs upon opening of the first and the second air control valves, the process proceeds to step S206. Preferably, however, the process proceeds to step S206 after ensuring the state of no pressure fluctuation, that is, confirming that such state has continued for a predetermined period of time.

In the case where no pressure fluctuation occurs upon opening of the first air control valve, and the pressure fluctuation occurs upon opening of the second air control valve, that is, the first air control valve has abnormality as shown in FIG. 4A or FIG. 4B (Case B1 or Case B2), the process proceeds to step S205. In this stage, however, it cannot be determined whether the abnormality is open abnormality or close abnormality. In step S205, it is determined whether the magnitude of the pressure fluctuation of the second air control valve is larger than a predetermined threshold value, or whether the pressure of the second air control valve upon start of the pressure fluctuation is larger than a predetermined threshold value.

When Yes is obtained in step S205, the abnormality is determined as case B2 shown in FIG. 4B. Then the process proceeds to step S210 where it is determined that the first air control valve has close abnormality (left closed), and the routine ends.

When No is obtained in step S205, the abnormality is determined as case B1 shown in FIG. 4A. Then the process proceeds to step S211 where it is determined that the first air control valve has open abnormality (left opened), and the routine ends.

In the case where no pressure fluctuation occurs upon opening of the first air control valve, and the pressure fluctuation occurs upon opening of the second air control valve, that is, both the first and the second air control valves have abnormality as shown in FIG. 6A or FIG. 6B (Case D1 or Case D2), No is obtained in step S203, and the process proceeds to step S206 as described above. In this stage, however, it cannot be determined whether the abnormality is open abnormality or close abnormality. In step S206, it is determined whether the value of the pressure with no fluctuation is larger than a predetermined threshold value.

When Yes is obtained in step S206, the abnormality is determined as the case D2 shown in FIG. 6B, and the process proceeds to step S212 where it is determined that both the first and the second air control valves have close abnormality (left closed), and the routine ends.

When No is obtained in step S206, the abnormality is determined as the case D1 shown in FIG. 6A, and the process proceeds to step S213 where it is determined that both the first and the second air control valves have open abnormality (left opened), and then the routine ends.

The embodiment makes it possible to determine not only presence or absence of abnormality in the air control valve but also the abnormality type, that is, open abnormality (left opened) or close abnormality (left closed) based on the combination of the pressure fluctuations upon opening of the first air control valve and the second air control valve. The embodiment requires only one pressure sensor for executing the aforementioned diagnosis based on the combination of those two values of pressure fluctuation at low costs with higher accuracy.

Figure 9:
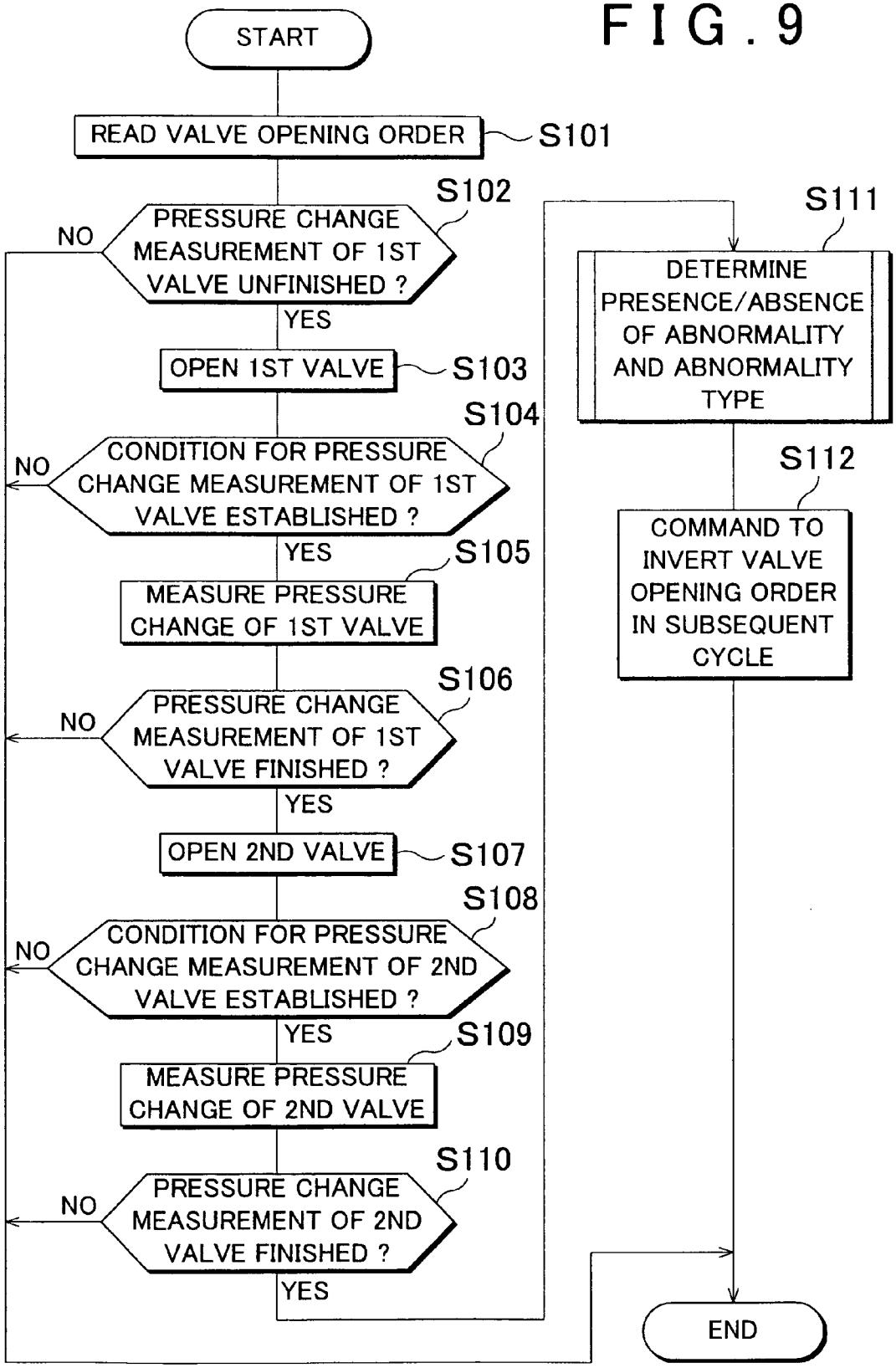
FIG. 9 is a flowchart of an abnormality diagnosis according to a modified example of the embodiment.

An abnormality diagnosis as a first modified example of the embodiment will be described referring to the flowchart of FIG. 9. The modified example is substantially the same as the embodiment except that the routine ends after execution of step S112 subsequent to step S111. In step S112, the command for inverting the valve opening order in the present diagnostic cycle is issued so as to be set for the subsequent diagnostic cycle, and the inverted order is stored in the nonvolatile memory of the ECU 30.

In the case where the air control valve 22*a* is opened firstly, and then the air control valve 22*b* is opened secondly in the present cycle, the valve opening order is inverted such that the air control valve 22*b* will be opened firstly and the control valve 22*a* will be opened secondly in the subsequent cycle.

The magnitude of the pressure fluctuation upon opening of the second air control valve is smaller than that of the pressure fluctuation upon opening of the first air control valve. Accordingly, the fluctuation as shown in FIG. 3 and FIG. 4A may not be accurately determined. In the first modified example, the pressure fluctuation detected as being small in the present cycle may be detected as being large in the subsequent cycle, resulting in more accurate diagnosis than the previous cycle.

Figure 10A:
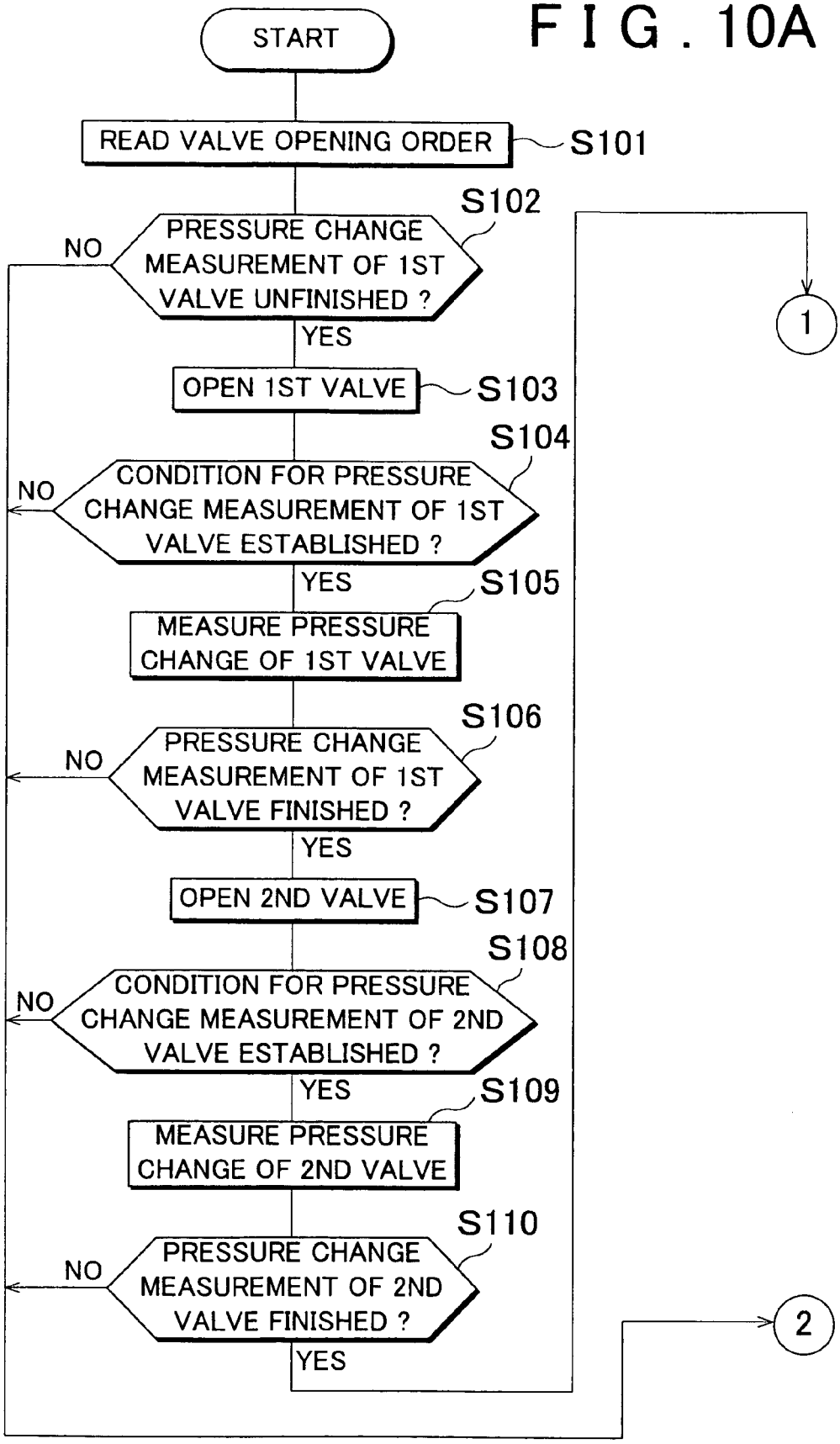
FIG. 10A and 10B are flowcharts of an abnormality diagnosis according to another modified example of the embodiment.
Figure 10B:
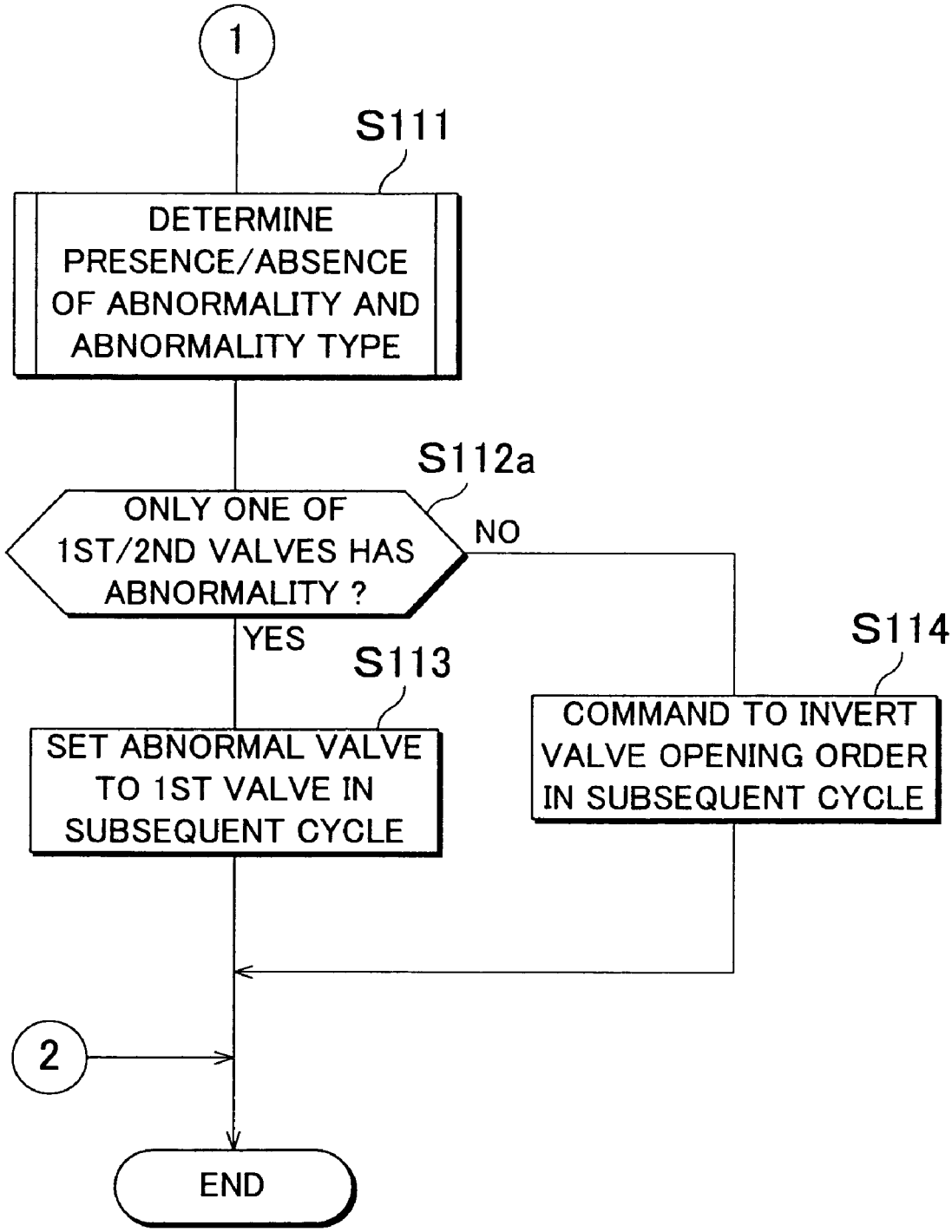

An abnormality diagnosis as a second modified example of the embodiment will be described. FIG. 10A and 10B are flowcharts of a control routine executed in the second modified example. The modified example is substantially the same as the embodiment except that the control routine executes steps S112*a*, 113, and 114 subsequent to step S111.

In step S112*a*, it is determined whether only one of the first and the second air control valves has abnormality, that is, the type of the abnormality is determined to be one of the cases B1, B2, C1, and C2.

When Yes is obtained in step S112*a*, the process proceeds to step S113 where the command for firstly opening the air control valve that has been determined as having abnormality is issued, and such command is stored in the back-up RAM of the ECU 30. For example, if the air control valve 22*a* is determined as having abnormality in the present cycle, the air control valve 22*a* will be firstly opened, and the air control valve 22*b* will be secondly opened in the subsequent cycle.

According to the modified example, even if the air control valve that has been determined as having abnormality is opened firstly or secondly in the present cycle, the determination in the subsequent cycle will be further accurate.

When No is obtained in step S112*a*, that is, the abnormality is classified as the case A, D1, or D2, the process proceeds to step S114 where the valve opening order in the present cycle is inverted for the subsequent cycle as in step S112 of the first modified example, and the order is stored in the back-up RAM of the ECU 30. The routine, then ends. The resultant effects are the same as those as described above.

Figure 11:
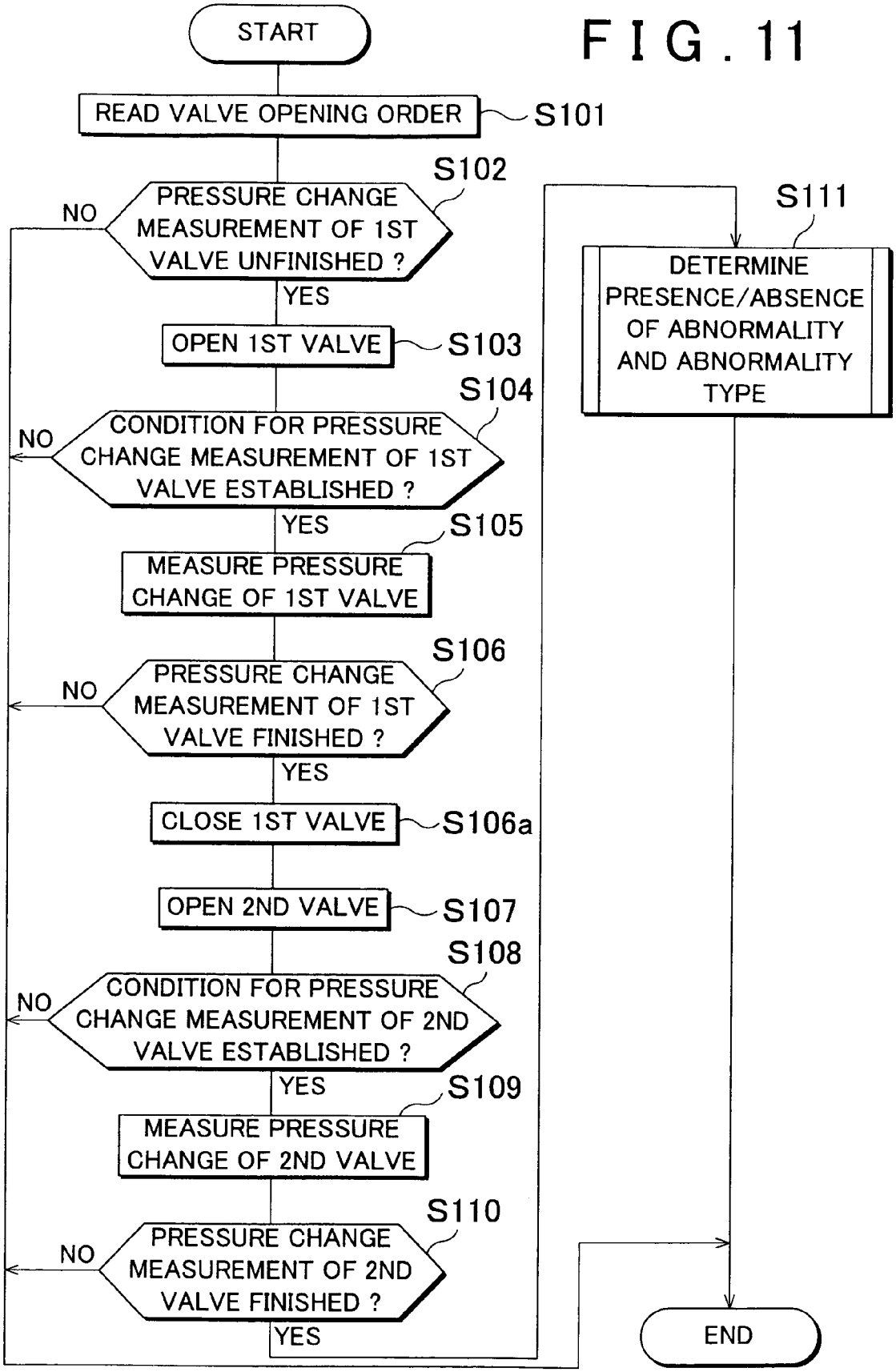
FIG. 11 is a flowchart of an abnormality diagnosis according to still further modified example of the embodiment.

An abnormality diagnosis as a third modified example of the embodiment will be described. FIG. 11 shows a flowchart of a control routine executed in the modified example. The modified example is substantially the same as the embodiment except that the control executes step S106*a* between steps S106 and S107. In step S106*a*, the first air control valve is closed.

In the modified example, upon opening of the second air control valve, secondary air is not supplied to the secondary air supply pipe having the first air control valve. Accordingly, the second air control valve can be opened at relatively higher pressure, resulting in larger pressure fluctuation. This makes it possible to improve the determination accuracy.

In the embodiment and the modified examples thereof according to the invention, each fluctuation of the pressure detected by the pressure sensor 20 is measured at different timings t1 and t2, based on which presence or absence of the abnormality or the abnormality type may be diagnosed.

The result of the aforementioned diagnosis in the embodiment and modified examples may be partially confirmed by determining the pressure pulsation during opening of the respective control valves.

For example, in the case where it is diagnosed that at least one of the air control valves has abnormality, when pulsation of the exhaust gas is detected by the pressure sensor upon the command for closing both the air control valves 22*a* and 22*b*, and for opening the auxiliary air control valve 21 is issued, it is determined that at least one of the air control valves diagnosed as having abnormality has the open abnormality (left opened).

A second embodiment of the invention will be described referring to the drawings. In the drawings, the same elements as those shown in the first embodiment will be designated as the same reference numerals. In the drawings, the scale is appropriately modified in order to facilitate understanding.

Figure 12:
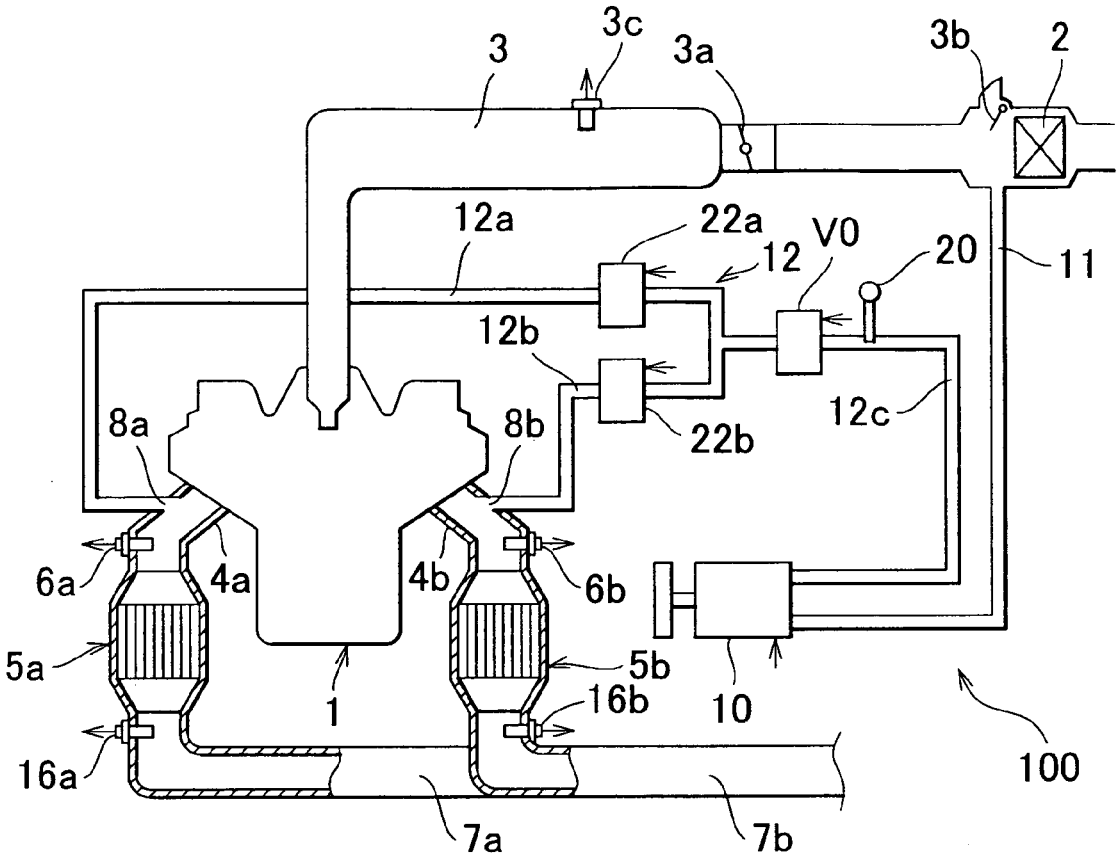
FIG. 12 is a schematic view of a secondary air supply system based on another embodiment of the invention.
Figure 12:
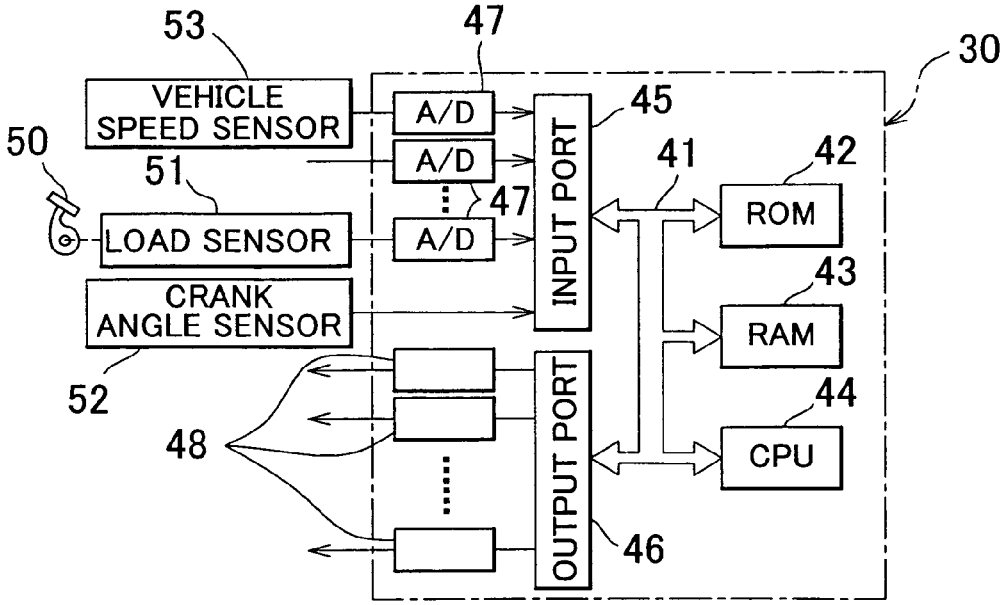

FIG. 12 is a schematic view showing a secondary air supply system according to the second embodiment of the invention. A secondary air supply system 100 is provided for an internal combustion engine 1, for example, a multi-cylinder V-type gasoline engine. Referring to FIG. 12, cylinders of left and right banks of the internal combustion engine 1 are connected with exhaust pipes 7*a*, 7*b*, respectively via exhaust manifolds 4*a*, 4*b*. Catalytic converters 5*a*, 5*b* each carrying a catalyst exhibiting oxidizing function are provided in the exhaust pipes 7*a*, 7*b*, respectively. Secondary air supply inlets 8*a*, 8*b* are formed in the exhaust pipes 7*a*, 7*b* upstream of those catalytic converters 5*a*, 5*b*. The secondary air supply inlets 8*a*, 8*b* are connected with two branch portions 12*a*, 12*b* of a secondary air supply pipe 12 to be described later. In the exhaust pipes 7*a*, 7*b*, $O_2$ sensors 6*a*, 6*b* are provided upstream of the catalytic converters 5*a*, 5*b*, and $O_2$ sensors 16*a*, 16*b* are provided downstream of the catalytic converters 5*a*, 5*b*, respectively. Each quantity of oxygen consumed by the catalytic converters 5*a*, 5*b* may be calculated by detecting the oxygen concentration at sections upstream and downstream of the catalytic converters 5*a*, 5*b*. A throttle valve 3*a* is provided in an intake pipe 3 that supplies intake gas into cylinders of the left and right banks of the internal combustion engine. The intake pipe 3 is connected to an air cleaner 2. An air flow meter 3*b* for detecting quantity of primary air is provided between the air cleaner 2 and the throttle valve 3*a*. A temperature sensor 3*c* is provided in the intake pipe 3 for detecting an intake air temperature.

An intake air pipe 11 that extends from a position between the throttle valve 3*a* in the intake pipe 3 and the air cleaner 2 is provided in the secondary air supply system 100. The intake air pipe 111 is connected with a power driven air pump 10 from where a joint portion 12*c* of the secondary air supply pipe 12 extends. Referring to FIG. 12, the secondary air supply pipe 12 is divided into two branch portions 12*a*, 12*b* each connected to the secondary air supply inlets 8*a*, 8*b* in the exhaust pipes 7*a*, 7*b*, respectively. As shown in FIG. 12, the branch portion 12*a* is provided with an air control valve 22*a*, and the branch portion 12*b* is provided with an air control valve 22*b*, respectively. The joint portion 12*c* of the secondary air supply pipe 12 is provided with an auxiliary air control valve 21. Each of those air control valves 21, 22*a*, 22*a* is formed as an air switching valve (ASV) or a vacuum switching valve (VSV), which is operated to control quantity of secondary air that flows through the branch portions 12*a*, 12*b* and the joint portion 12*c* of the secondary air supply pipe 12 by the ECU 30. A pressure sensor 20 is provided in the secondary air supply pipe 12 between the auxiliary air control valve 21 and the power driven air pump 10. The pressure sensor 20 is provided upstream of the auxiliary air control valve 21. Although FIG. 12 shows that secondary air is taken from the intake pipe 3, it may be directly taken from atmosphere.

The ECU 30 is formed as a digital computer provided with a ROM (Read Only Memory) 42, a RAM (Random Access Memory) 43, a CPU (microprocessor) 44, an input port 45, and an output port 46, which are connected one another via bi-directional bus 41. Referring to FIG. 12, output signals from the $O_2$ sensors 6*a*, 6*b* upstream of the catalytic converters 5*a*, 5*b*, and the $O_2$ sensors 16*a*, 16*b* downstream of the catalytic converters 5*a*, 5*b* are input to the input port 45 via corresponding AD converters 47, respectively. Signals output from the temperature sensor 3*c* in the intake passage and an engine cooling water temperature sensor (not shown) are input to the input port 45 via the corresponding AD converters 47, respectively. A load sensor 51 is connected to an accelerator pedal 50 so as to generate an output voltage proportional to a depression amount L of the accelerator pedal 50. The output voltage of the load sensor 51 is input to the input port 45 via the corresponding AD converter 47. The input port 45 is connected to a crank angle sensor 52 that generates an output pulse at every rotation of a crankshaft at 30°, for example. An output pulse of a vehicle speed sensor 53 indicating a vehicle speed is input to the input port 45. Meanwhile the output port 46 is connected to a fuel injection valve (not shown) of the internal combustion engine 1, a step motor (not shown) for controlling the throttle valve 3*a*, the auxiliary air control valve 21 provided in the secondary air supply pipe 12, branch portions 12*a*, 12*b*, air control valves 22*a*, 22*b* provided therein, and the power driven air pump 10, via corresponding driving circuits 48, respectively.

As the catalyst exhibiting oxidizing function provided in the catalytic converters 5*a*, 5*b*, the oxidizing catalyst, three-way catalyst, absorption reduction type $NO_X$ catalyst for reduction by releasing $NO_X$ that has been absorbed or the like may be employed. The $NO_X$ catalyst functions in releasing $NO_X$ when the average air/fuel ratio in the combustion chamber becomes rich. The $NO_X$ catalyst employs alumina as its carrier that carries a combination of at least one of elements selected from the alkaline metal such as kalium K, lithium Li, cesium Cs and the like, alkaline earth such as barium Ba, calcium Ca and the like, rare earth such as lanthanum, yttrium and the like, and a noble metal such as platinum Pt.

The secondary air supply system 100 is operated in the state where the exhaust emission control device cannot fulfill its function, that is, the fuel concentration during cold start-up is high, the air/fuel ratio is low, and the temperature of the catalytic converters 5*a*, 5*b* as the exhaust emission control device has not been sufficiently raised. The oxygen concentration in the catalytic converters 5*a*, 5*b* may be increased by supplying secondary air thereinto. This makes it possible to remove CO, HC, and $NO_X$ contained in the exhaust gas.

Figure 13:
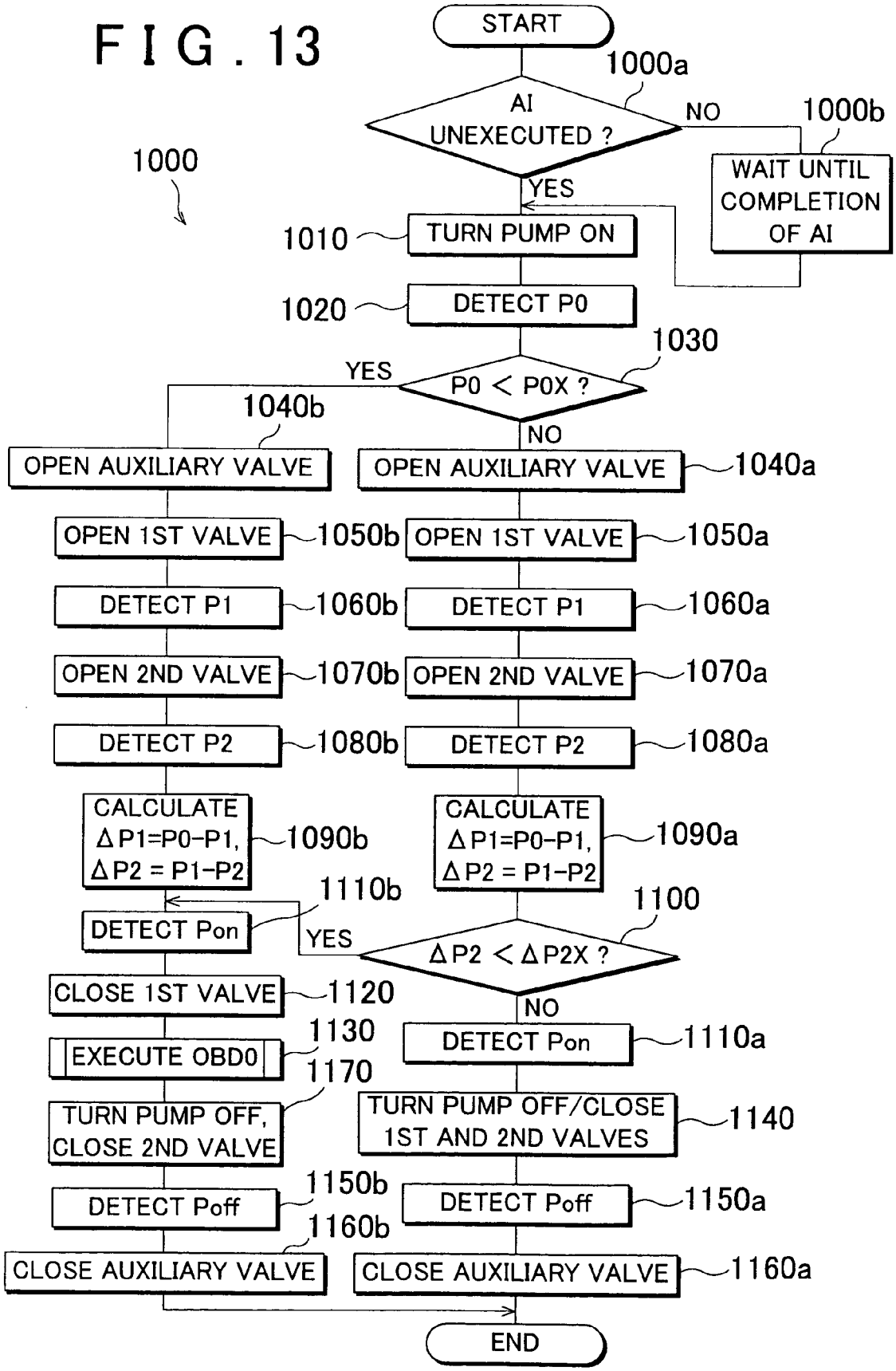
FIG. 13 is a flowchart of an operation for detecting abnormality in a secondary air supply system according to the embodiment.
Figure 14:
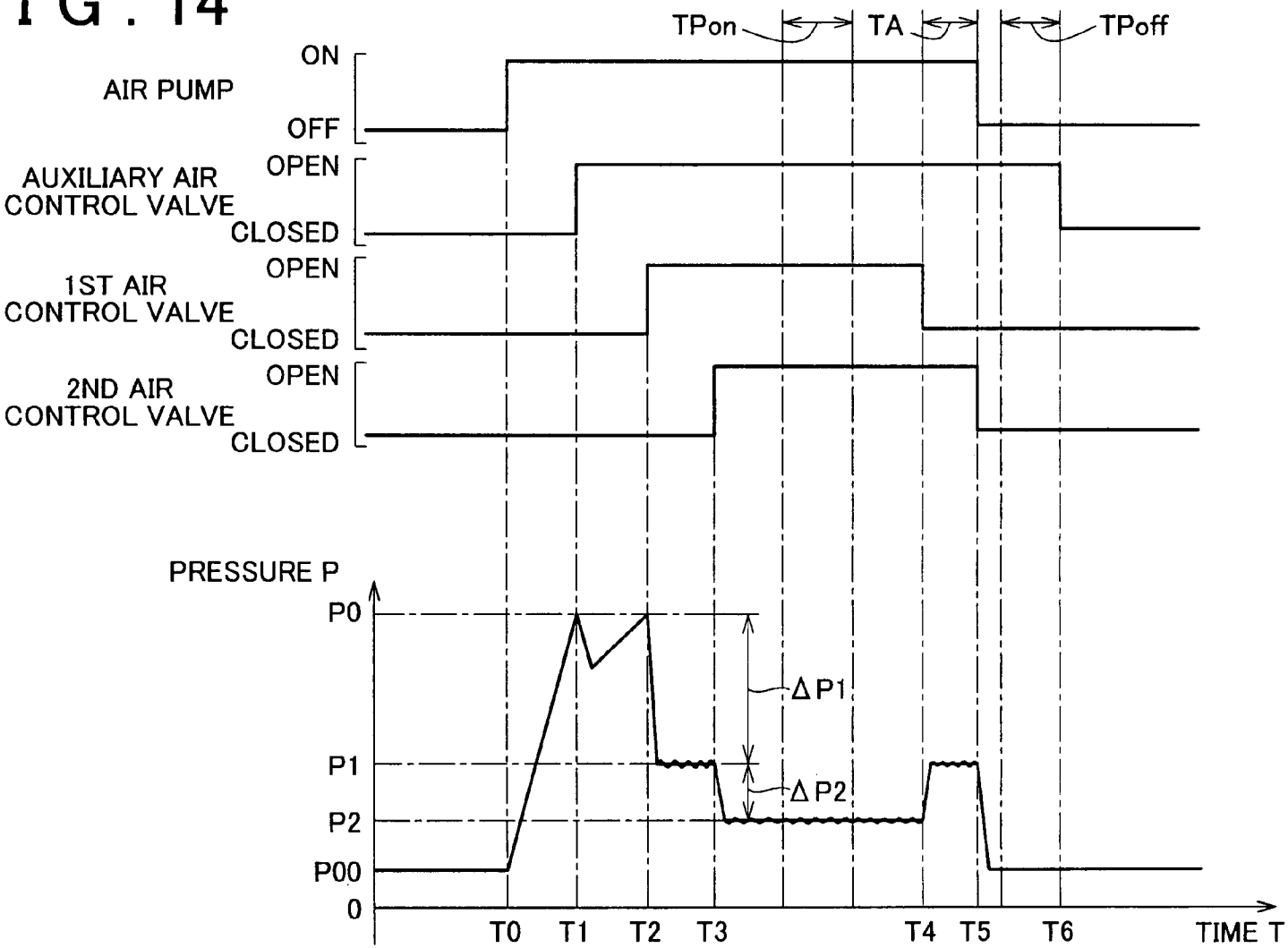
FIG. 14 is a timing chart showing an operation for detecting abnormality in the secondary air supply system according to the embodiment of the invention.

FIG. 13 is a flowchart showing a control routine for detecting abnormality in the secondary air supply system according to the embodiment of the invention. FIG. 14 is a timing chart showing the operation for detecting abnormality in the secondary air supply system according to the invention. The operation for detecting abnormality in the secondary air supply system according to the invention will be described referring to FIGS. 13 and 14. Each value of pressures P00, P0, P1, P2, Pon and Poff and pressure differences ΔP1, ΔP2 (described later) detected in the aforementioned control routine may be used in another control routine for detecting abnormality. Accordingly steps for measuring other values of the pressure and pressure difference except those required for the invention may be omitted.

Referring to the flowchart of FIG. 13, in step 1000*a* of a control routine 1000, it is determined whether a secondary air supply control (hereinafter simply referred to as AI in the following description and the drawings) is unexecuted. In this case, upon establishment of the conditions where the air control valves 22*a*, 22*b* at downstream sides are opened, the auxiliary air control valve 21 at the upstream side is opened, and the power driven air pump 10 is driven to supply secondary air to the catalytic converters 5*a*, 5*b*, respectively, it may be determined that the AI is executed.

If it is determined that the AI is unexecuted in step 1000*a*, the process proceeds to step 1010. Meanwhile if it is determined that the AI is executed in step 1000*a*, the process proceeds to step 1000*b* where the operation waits until completion of the AI process, and the process proceeds to step 1010.

In step 1010, the power driven air pump 10 of the secondary air supply system 100 is activated. Referring to FIG. 14, the timing at which the power driven air pump 10 is activated is set to T0. Then the process proceeds to step 1020 where the pressure P0 within the secondary air supply pipe 12 at a time just before the time T1 is detected by the pressure sensor 20. Then in step 1030, it is determined whether the pressure P0 is smaller than a predetermined value P0X, that is, P0<P0X. When it is determined that the pressure P0 is smaller than the predetermined value P0X, it is determined that the discharging capability of the power driven air pump 10 has been deteriorated owing to aging. The process then proceeds to step 1040*b*. When it is determined that the pressure P0 is larger than the predetermined value P0X, the process proceeds to step 1040*a*. An initial pressure P00 prior to activation of the power driven air pump 10 may be preliminarily detected so as to determine whether the pressure difference ΔP0 between the initial pressure P00 and the pressure P0, that is, P00−P0, is smaller than a predetermined value.

In step 1040*a*, the auxiliary air control valve 21 at the upstream side in the joint portion 12*c* of the secondary air supply pipe 12 is opened. Referring to FIG. 14, the pressure P temporarily drops as the auxiliary air control valve 21 is opened. However, it is increased up to the pressure P0 again. The process proceeds to step 1050*a* where the air control valve 22*a* at the downstream side provided in the branch portion 12*a* is opened from the time T1 until an elapse of a predetermined time, that is, the time T2. Accordingly the pressure P of the secondary air supply pipe 12 drops from the pressure P0 to the pressure P1. Then the pressure P1 is measured in step 1060*a*. The process proceeds to step 1070*a* where the air control valve 22*b* at the downstream side provided in the branch portion 12*b* is opened from the time T2 until an elapse of a predetermined time, that is, the time T3. Accordingly the pressure P further drops from the pressure P1 to the pressure P2. Then the pressure P2 is measured in step 1080*a*. The process proceeds to step 1090*a* where the pressure difference ΔP1 (=P0−P1) between the pressures P0 and P1, and the pressure difference ΔP2 (P1−P2) between the pressures P1 and P2 are calculated.

Referring to FIG. 14, when the air control valve 22*b* is opened after opening of the air control valve 22*a*, the pressure difference ΔP2 between the pressures P1 and P2 is smaller than the pressure difference ΔP1 between the pressures P0 and P1. In the case where determination with respect to abnormality in each of the air control valves 22*a*, 22*b* is made based on the determination whether the pressure difference ΔP1 or ΔP2 is larger than a predetermined value, the appropriate determination may be made with respect to the pressure difference ΔP1 that is relatively large. As the relatively small pressure difference ΔP2 is smaller than the predetermined value (actually, it is not so small compared with the pressure difference ΔP1), it is likely to be determined that there is abnormality. Accordingly, it is determined whether the pressure difference ΔP2 is smaller than a predetermined value ΔP2X, that is, ΔP2<ΔP2X in step 1100. The process proceeds to step 1160*a* only when it is determined that the pressure difference ΔP2 is larger than the predetermined value ΔP2X. When the pressure difference ΔP2 is smaller than the predetermined value ΔP2X, the process proceeds to step 1110*b*. In step 1130, an OBD0 process is executed (described later).

Figure 19:
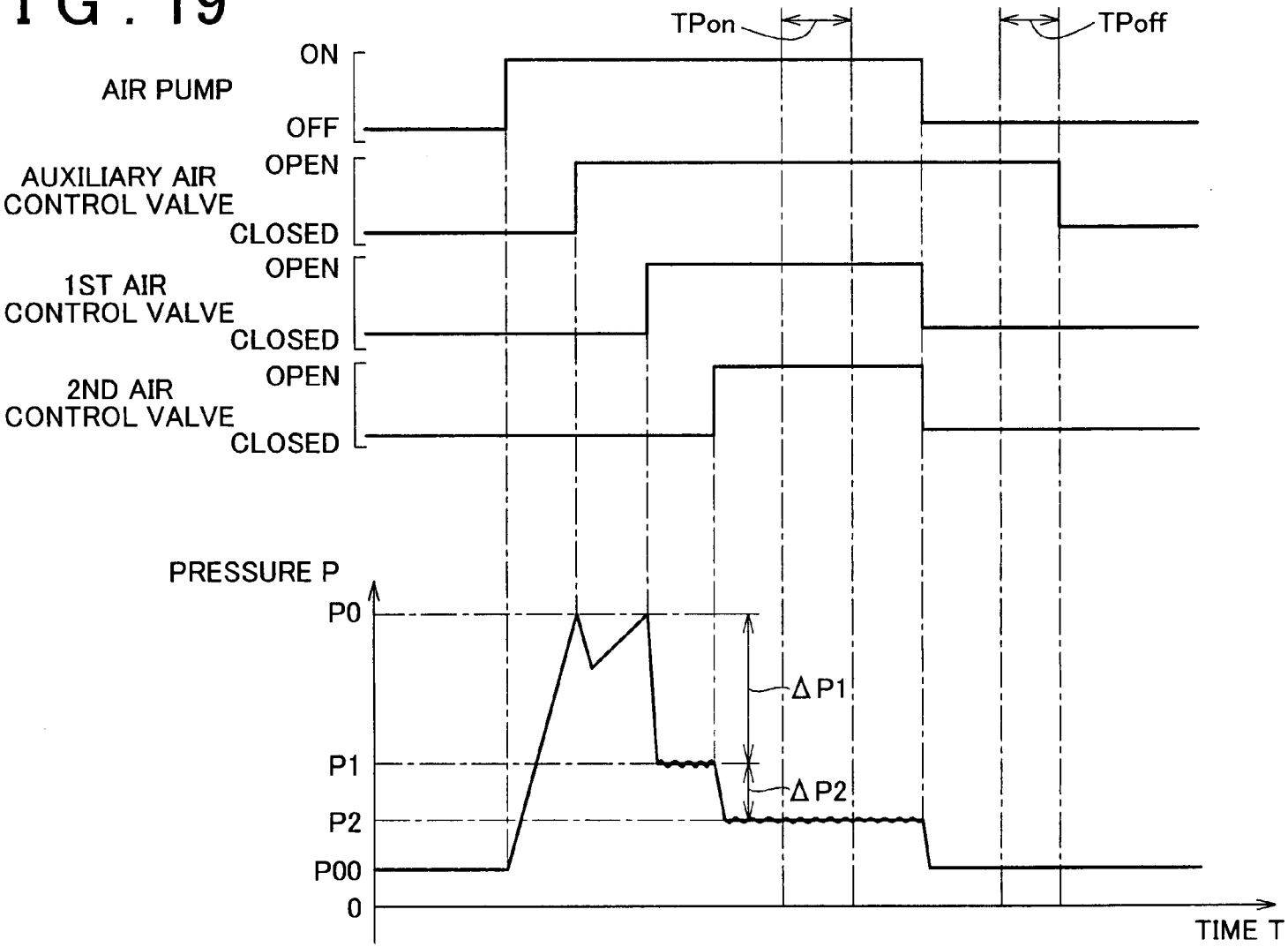
FIG. 19 RELATED ART
FIG. 19 is a timing chart showing general operation of the secondary air control apparatus and a graph representing a relationship between the time and pressure.

In step 1110*a*, the pressure Pon in the secondary air supply pipe 12 is measured during the secondary air supply from the time T3 until an elapse of a predetermined period of time (refer to the time period TPon shown in FIG. 19). Then in step 1140, the power driven air pump 10 is stopped and the air control valves 22*a*, 22*b* at the downstream sides are closed at substantially the same time (refer to FIG. 19). In step 1150*a*, the pressure Poff in the secondary air supply pipe 12 is measured while secondary air is not supplied for a predetermined period after a predetermined elapse of time from closing of the air control valves 22*a*, 22*b* (refer to the time period TPoff in FIG. 19). In step 1160*a*, the auxiliary air control valve 21 is closed, and the routine ends. Those pressure values of Pon, Poff and the like may be employed in the other OBD processing.

When it is determined that the pressure P0 is smaller than the predetermined value P0X in step 1030, the process proceeds to step 1040*b* in the flowchart of FIG. 13. As each process from steps 1040*b* to 1090*b* are the same as that from steps 1040*a* to 1090*a* as aforementioned, the explanation of those steps will be omitted. Although the normal AI process is executed in steps 1040*a* to 1090*a*, quantity of secondary air may be reduced by shortening the time for opening the air control valves in steps from 1040*b* to 1090*b*. The process proceeds to step 1040*b* as it is determined that the discharging capability of the power driven air pump 10 has been deteriorated owing to aging. Accordingly the pressure differences ΔP1 and ΔP2 calculated in step 1090*b* become smaller than those calculated in step 1090*a*, respectively. In the case where the determination is made with respect to abnormality of the air control valves 22*a*, 22*b* by making a determination whether each of the pressure differences ΔP1 and ΔP2 is larger than the predetermined value, it is likely to be determined that the air control valves 22*a*, 22*b* have abnormality contrary to the actual state where they are normally operated. After calculation of the pressure differences ΔP1 and ΔP2 in step 1090*b*, the process proceeds to step 1110*b*, and in step 1130, the OBD0 process (described later) is executed. In the case where the OBD0 process is executed in accordance with the value of the pressure P0, the secondary air supply control does not have to be executed. Therefore, the time for opening the air control valves 22*a*, 22*b* is adjusted so as to prevent extreme deterioration in the emission.

When it is determined that the pressure difference ΔP2 is smaller than the predetermined value ΔP2X in step 1100, the process proceeds to step 1110*b* where the pressure Pon is measured as in step 1110*a*. Then in step 1120, the air control valve 22*a* at the downstream side that has been opened firstly is only closed at a time T4. Accordingly in step 1120, the power driven air pump 10 is driven and the auxiliary air control valve 21 at the upstream side and the air control valve 22*b* at the downstream side are opened. As shown in FIG. 14, the pressure P in the secondary air supply pipe 12 is increased again by closing the air control valve 22*a*. Then in step 1130, the OBD0 process as the OBD process according to the invention is executed. Upon completion of the OBD0 process, the process proceeds to step 1170 where the power driven air pump 10 is stopped and the air control valve 22*b* is closed at a time T5. Accordingly the pressure P drops to the initial pressure P00. The time period for which one of the air control valves, that is, 22*a* is closed and the other air control valve 22*b* is opened from the times T4 to T5 will be referred to as TA. The process further proceeds to step 1160*b* where the auxiliary air control valve 21 is closed at a time T6, and the routine ends.

Figure 15A:
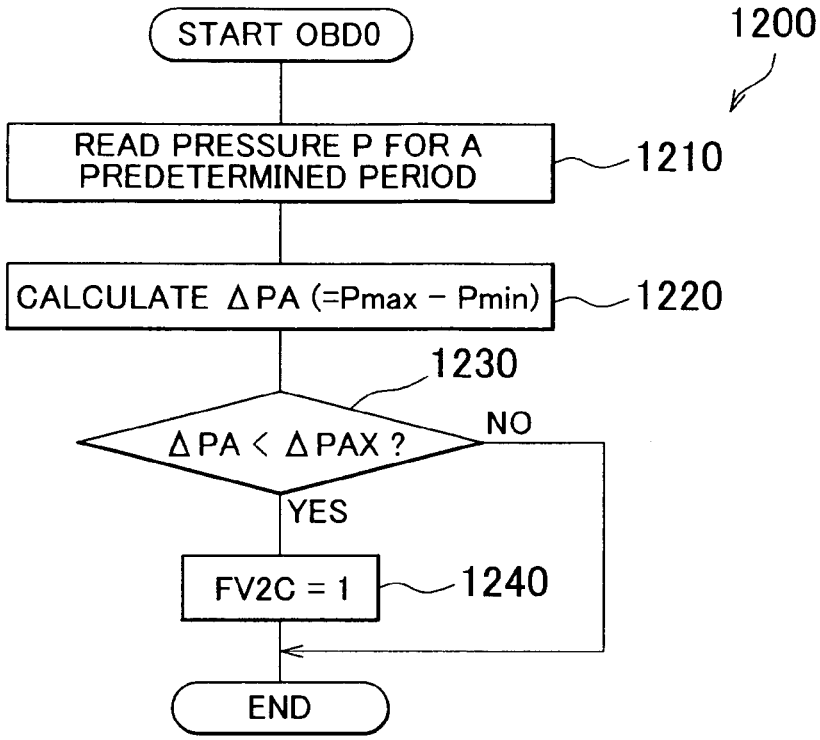
FIG. 15A is a flowchart showing a first OBD0 processing in the invention.
Figure 15B:
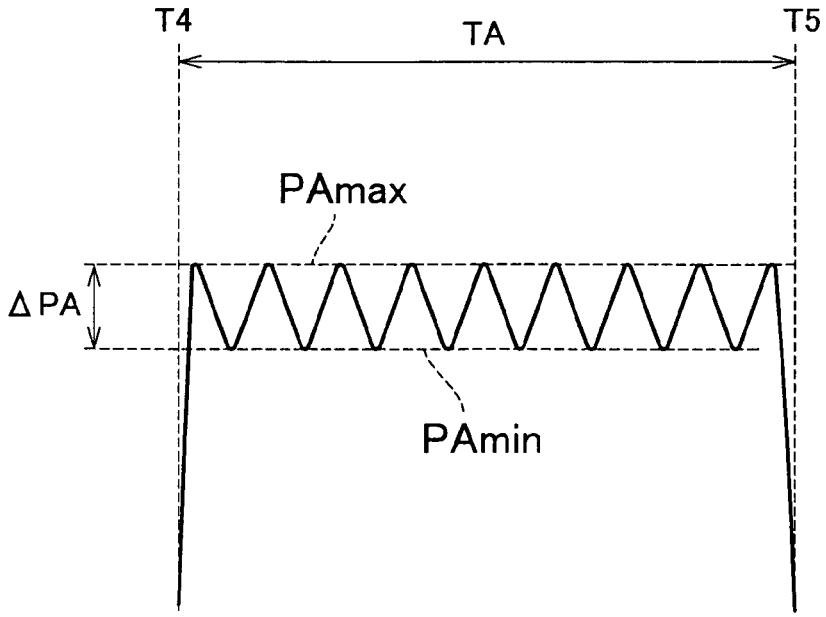
FIG. 15B is a view representing a relationship between the time and pressure.

The OBD0 process according to the invention will be described. FIG. 15A is a flowchart showing a first OBD0 process according to the invention. In step 1210 of the first OBD0 process 1200, the pressure P in the secondary air supply pipe 12 during the period TA is detected by the pressure sensor 20 for a predetermined period of time. Then in step 1220, the difference ΔPA is calculated by the ECU 30 based on the pressure P detected in step 1210. The deviation ΔPA will be described referring to FIG. 15B representing a relationship between time and pressure. The axis of abscissas in the graph of FIG. 15B represents time, and axis of ordinate represents the pressure P detected by the pressure sensor 20. As shown in FIG. 15B, the pressure P fluctuates, drawing like substantially sinusoidal wave with respect to time. When the maximum value and minimum value of the pressure P at the predetermined time are set to PAmax and PAmin, respectively, the difference ΔPA is equivalent to the difference between the PAmax and PAmin (PAmax−Pamin). If the pressure P fluctuates, drawing like sinusoidal wave without amplitude variation, the difference ΔPA may be set to the value twice the amplitude.

The process proceeds to step 1230 where it is determined whether the difference ΔPA is smaller than the predetermined value PAX, that is, ΔPA<PAX. During execution of the OBD0 process according to the invention, one of the air control valves at the downstream side, that is, 22*a* is closed and the other air control valve 22*b* is opened. As the auxiliary air control valve 21 at the upstream side is opened in the aforementioned state, the pressure pulsation of the exhaust gas generated in the exhaust pipes 7*a*, 7*b* of the internal combustion engine 1is measured by the pressure sensor 20 through the downstream side control valve 22*b* and the upstream side auxiliary air control vale 21. If the pressure pulsation is not detected, that is, the difference ΔPA is smaller than the predetermined value PAX, it may be determined that the pressure pulsation has not passed through the air control valve 22*b*. In other words, the downstream side air control valve 22*b* has close abnormality (left closed). Accordingly the process proceeds to step 1240 where a flag FV2*c* indicating the close abnormality of the air control valve 22*b* is set to 1, and the routine ends. In the invention, accuracy in determination of abnormality with respect to the second air control valve, that is, 22*b* that is opened subsequent to opening of the first air control valve, that is, 22*a* may be improved. When it is determined that the difference ΔPA is larger than the predetermined value PAX in step 1230, it may be determined that the air control valve 22*b* is normally operated as it allows passage of the pressure pulsation. The routine then ends.

Figure 16A:
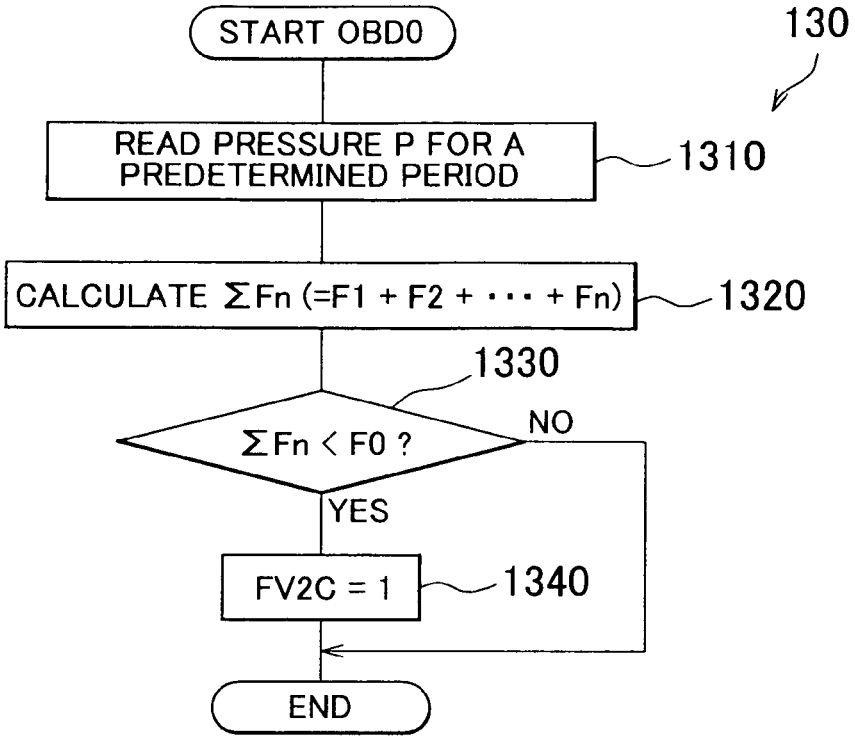
FIG. 16A is a flowchart showing a second OBD0 processing in the invention.
Figure 16B:
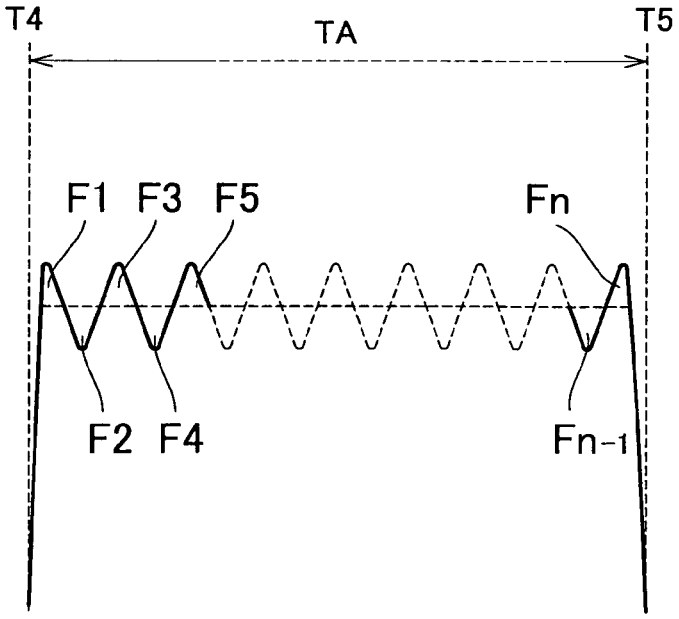
FIG. 16B is a view representing a relationship between the time and pressure.

FIG. 16A is a flowchart showing a second OBD0 process according to the invention. In step 1310 of the second OBD0 process 1300, the pressure P within the secondary air supply pipe 12 at the time TA is measured by the pressure sensor 20 for a predetermined period of time likewise step 1210 of the first OBD0 process 1200. The process proceeds to step 1320 where a pressure area ΣFn is derived from the pressure P measured in step 1310 by the ECU 30. The pressure area ΣFn will be described referring to FIG. 16B that is conceptually similar to FIG. 15B representing the relationship between time and pressure. Referring to FIG. 16B, sections each defined by the center of the vibration of the pressure P and the trajectory of the pressure P are referred to as F1, F2, . . . , Fn sequentially within a predetermined period of time. Each area of those sections F1 to Fn is calculated and summed up. The ΣFn corresponds with the total area of the sections from F1 to Fn (F1+F2+ . . . +Fn).

The process further proceeds to step 1330 where it is determined whether the total area ΣFn is smaller than a predetermined value F0, that is, ΣFn<F0. Likewise the aforementioned embodiment, the pressure pulsation of the exhaust gas generated in the exhaust pipes 7*a*, 7*b* of the internal combustion engine 1 is detected by the pressure sensor 20 through the downstream side air control valve 22*b* and the upstream side auxiliary air control valve 21. Accordingly in the case where the pressure pulsation cannot be detected, that is, the total area ΣFn is smaller than a predetermined value F0, it may be determined that the pressure pulsation has not passed through the downstream air control valve 22*b*. That is, it may be determined that the downstream air control valve 22*b* has close abnormality. The process proceeds to step 1340 where the flag FV2*c* indicating that the downstream air control valve 22*b* has close abnormality is set to 1. The routine then ends. This makes it possible to provide effects that are the same as those described above. When it is determined that the total area ΣFn is larger than a predetermined value F0, it is determined that the pressure pulsation has passed through the air control valve 22*b*. Accordingly the air control valve 22*b* is determined to be normally operated, and the routine ends.

Figure 17:
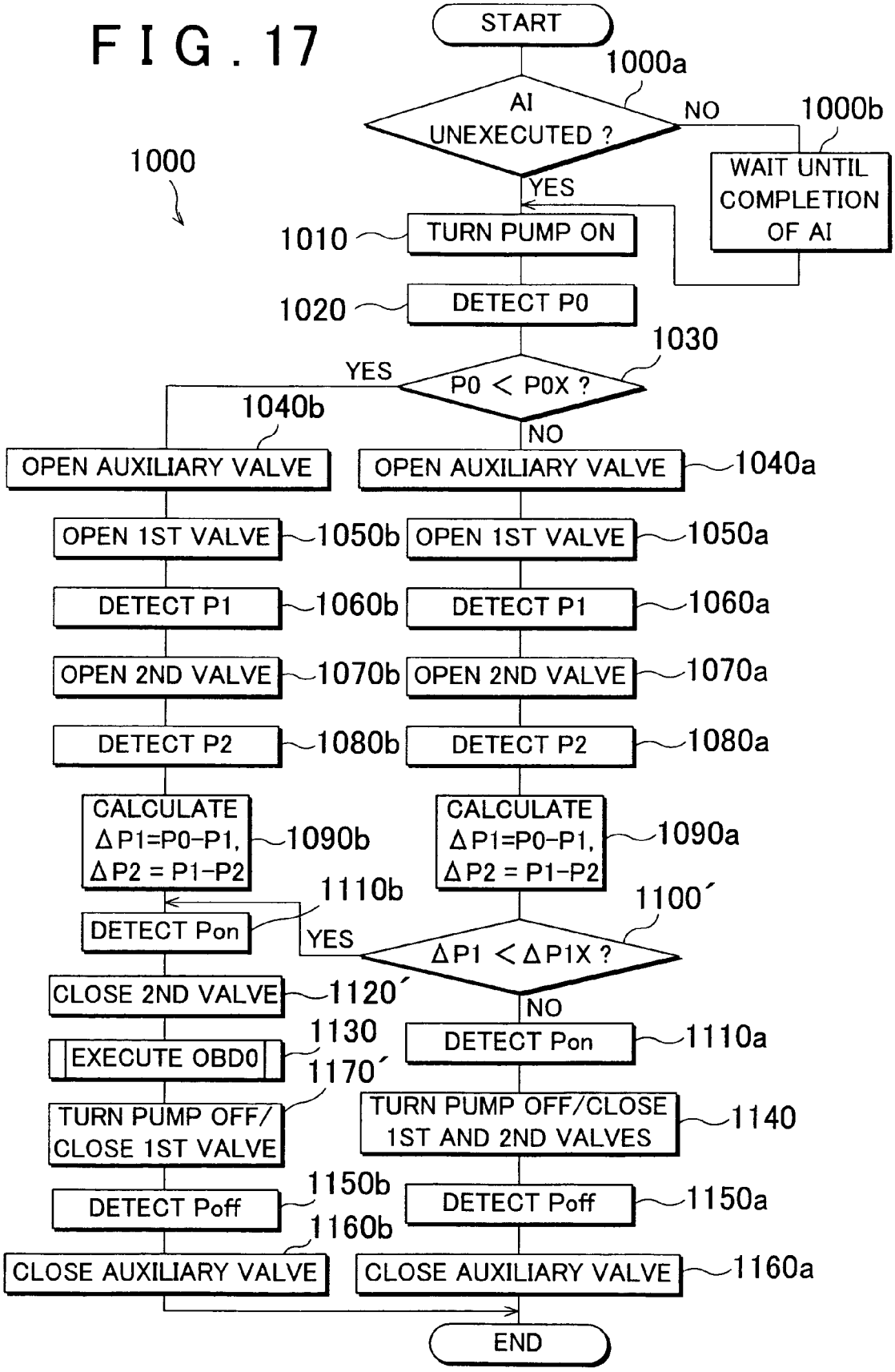
FIG. 17 is a flowchart showing another routine for detecting abnormality in the secondary air supply system according to the invention.
Figure 18:
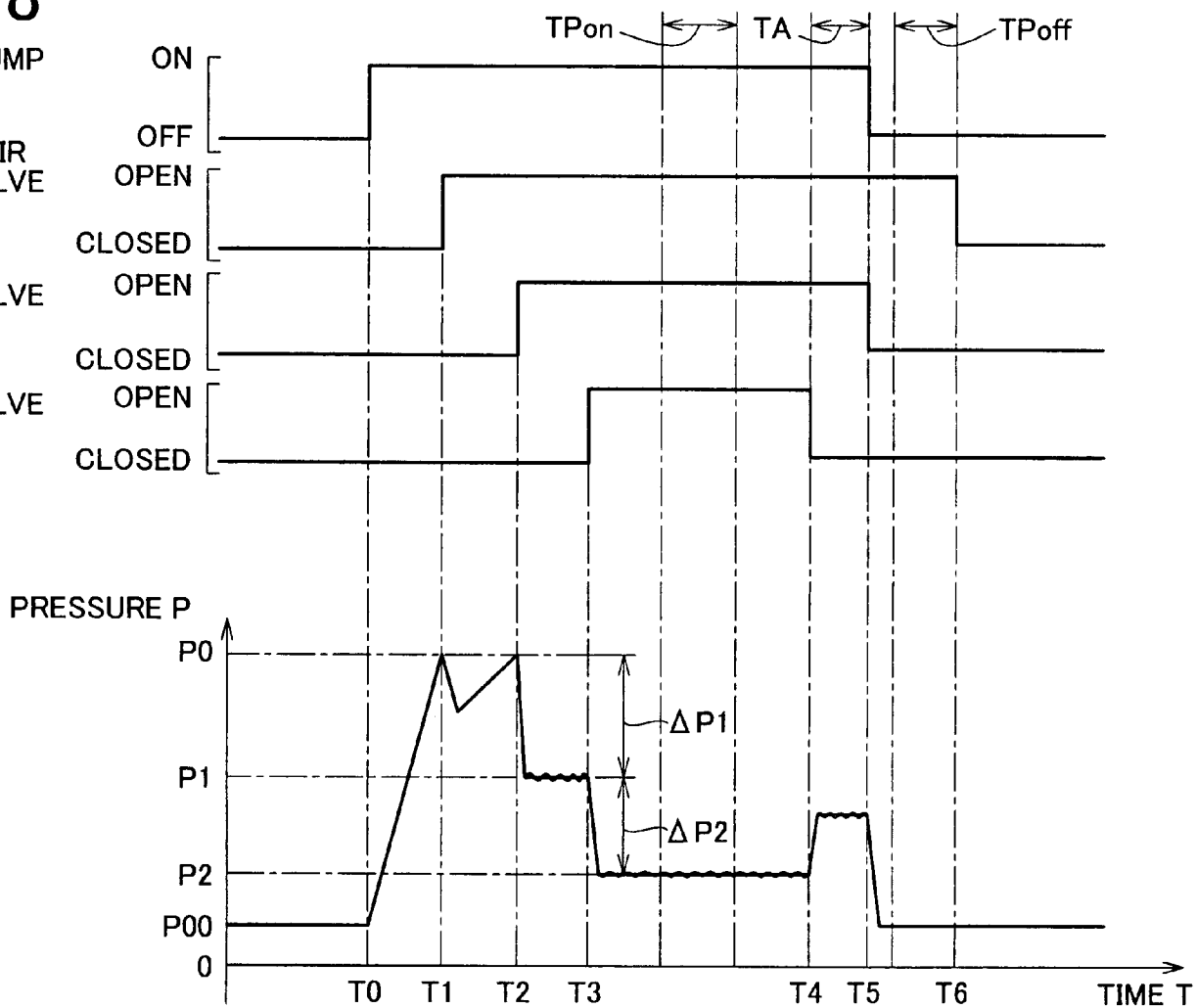
FIG. 18 is a timing chart showing another routine for detecting abnormality in the secondary air supply system according to the invention.

FIG. 17 is a flowchart showing other routine for detecting abnormality of the secondary air supply system according to the invention. FIG. 18 is other timing chart that shows the operation for detecting abnormality of the secondary air supply system according to the invention. The other operation routine for detecting abnormality will be described referring to the drawings. Referring to steps of the flowchart in FIG. 17, steps designated with the same reference numerals as those in steps shown in FIG. 13 are identical thereto. Accordingly the explanation of such step will be omitted. In the other operation routine as shown by step 1100' of the flowchart shown in FIG. 17, it is assumed that the pressure difference ΔP1 between the pressures P0 and P1 becomes smaller than the predetermined value ΔP1X. In other words, in the other operation routine, when the pressure difference ΔP1 is smaller than the predetermined value ΔP1X, the OBD0 process described referring to FIGS. 15A, 16B, 16A and 16B will be executed. In step 1120' of the flowchart in FIG. 17 and FIG. 14, upon start of the OBD0 process, the air control valve 22*b* is only closed at the time T4 so as to forcedly bring the state where the air pump 10 is driven, and the upstream auxiliary air control valve 21 and the downstream air control valve 22*a* are opened. Then the OBD0 process as aforementioned with respect to the pressure P is executed. When the pressure pulsation is not detected, it is determined that the air control valve 22*a* has close abnormality. This makes it possible to improve accuracy for detecting abnormality in the air control valve 22*a*. As shown in step 1170', the power driven air pump 10 is stopped at the time T5 and the air control valve 22*a* is closed.

The internal combustion engine 1 described referring to FIG. 12 has two banks. The branch portions 12*a*, 12*b* are connected to the exhaust pipes 7*a*, 7*b* extending from the respective banks. In the case where a single bank is provided in the internal combustion engine including relatively large number of cylinders, two exhaust pipes (not shown) may be provided for the single bank. The operation routine for detecting abnormality according to the invention may be applied to the aforementioned structure.

In the case where the number of exhaust pipes (not shown) provided in the internal combustion engine is n (N>3), the secondary air supply pipe 12 is divided into branch portions by the number equal to that of the exhaust pipes. Additionally each of the resultant branch portions is provided with each of corresponding air control valves VX1 to VXn (not shown), respectively. Likewise the internal combustion engine including three or more banks may be provided with three or more air control valves VX1 to VXn each extending from the corresponding bank. In the above-structured internal combustion engine, the power driven air pump 10 is activated to open the auxiliary air control valve 21 in the secondary air supply pipe 12, and then the air control valves VX1 to VXn are opened in that order such that the pressure is detected by the pressure sensor 20 sequentially. When the difference between the pressure detected upon opening of the air control valve VXn-1 opened second to the last air control valve and the pressure detected upon opening of the last air control valve VXn is smaller than a predetermined value, the air control valve VXn is only opened while driving the power driven air pump 10 and closing the air control valves VX0, VX1 to VXn-1. As aforementioned referring to FIGS. 15A, 15B, 16A, 16B, when the resultant pressure pulsation is smaller than a predetermined value, it may be determined that the air control valve VXn has close abnormality due to the reason as aforementioned above. Meanwhile, when the difference between the pressure upon opening of the air control valve VX1 firstly opened and the pressure upon opening of the air control valve VX2 secondly opened is smaller than a predetermined value, the air control valve VXn is only opened while driving the power driven air pump 10 and closing the air control valves VX0, VX2 to VXn-1. As aforementioned referring to FIGS. 15A, 15B, 16A, 16B, when the resultant pressure pulsation is smaller than a predetermined value, it may be determined that the air control valve VX1 has close abnormality due to the reason as aforementioned above.

What is claimed is:

1. A secondary air supply system that supplies secondary air to each of exhaust pipes attached to each of two banks of an internal combustion engine via a secondary air supply pipe including a joint portion and two branch portions divided from the joint portion, the secondary air supply system comprising two air control valves respectively provided in the two branch portions, and a pressure sensor provided in the joint portion of the secondary air supply pipe, wherein an abnormality diagnosis is executed with respect to the two air control valves which are opened at different timings, the two air control valves including a first air control valve that is firstly opened and a second air control valve that is secondly opened, based on a combination of a fluctuation of a pressure in the joint portion detected by the pressure sensor upon opening of the first air control valves and a fluctuation of a pressure in the joint portion detected by the pressure sensor upon opening of the second air control valve.

2. The secondary air supply system according to claim 1, wherein the second air control valve is opened while holding the first air control valve opened.

3. The secondary air supply system according to claim 2, wherein a valve opening order for opening the two air control valves in a present cycle of the abnormality diagnosis is inverted in a subsequent cycle of the abnormality diagnosis.

4. The secondary air supply system according to claim 2, wherein when one of the two air control valves is diagnosed as having abnormality in a present cycle of the abnormality diagnosis, the air control valve diagnosed as having abnormality is to be opened firstly in a subsequent cycle of the abnormality diagnosis.

5. The secondary air supply system according to claim 1, wherein the first air control valve is closed upon completion of a measurement of the fluctuation of the pressure upon opening of the first air control valve, and the second air control valve is opened thereafter.

6. The secondary air supply system according to claim 5, wherein when at least one of the two air control valves is determined as having abnormality, a type of the abnormality including an open abnormality and a close abnormality is determined based on a result of a comparison between the fluctuation of the pressure detected upon opening of the first air control valve and the fluctuation of the pressure detected upon opening of the second air control valve.

7. The secondary air supply system according to claim 1, wherein it is determined whether the two air control valves are normally operated, the first air control valve has abnormality and the second air control valve is normally operated, the first air control valve is normally operated and the second air control valve has abnormality, and the two air control valves have abnormality, based on a combination of one of absence and presence of the fluctuation of the pressure occurred upon opening of the first air control valve, and one of absence and presence of the fluctuation of the pressure occurred upon opening of the second air control valve.

8. The secondary air supply system according to claim 1, wherein an auxiliary air control valve is provided at a portion downstream of the pressure sensor in the joint portion of the secondary air supply pipe.

9. The secondary air supply system according to claim 8, wherein when at least one of the two air control valves is diagnosed as having abnormality, and a pressure pulsation of exhaust gas is detected by the pressure sensor upon a command for closing the two air control valves and opening the auxiliary air control valve, the at least one of the two air control valves diagnosed as having abnormality is determined as having an open abnormality.

10. The secondary air supply system according to claim 1, further comprising a pump that is provided on the joint portion of the secondary air supply pipe for supplying secondary air, and an auxiliary air control valve that is provided downstream of the pump for opening and closing the joint portion, the pressure sensor being provided between the pump and the auxiliary air control valve for measuring a pressure in the joint portion such that an abnormality in components of the secondary air supply system is detected based on a pressure value and a pressure change value detected by the pressure sensor, wherein when the pressure change value between the pressure value in the joint portion upon opening of the first air control valve and the pressure value in the joint portion upon opening of the second air control valve is smaller than a predetermined value upon opening of the two air control valves at different timings while driving the pump and opening the auxiliary air control valve, the abnormality in the second air control valve is diagnosed based on a pressure pulsation in the joint portion in a state where the second air control valve is closed and the first air control valve is closed, which has been brought by extending a timing for closing the second air control valve.

11. The secondary air supply system according to claim 1, further comprising a pump that is provided on the joint portion of the secondary air supply pipe for supplying secondary air, and an auxiliary air control valve that is provided downstream of the pump for opening and closing the joint portion, the pressure sensor being provided between the pump and the auxiliary air control valve for measuring a pressure in the joint portion such that an abnormality in components of the secondary air supply system is detected based on a pressure value and a pressure change value detected by the pressure sensor, wherein when a pressure detected by the pressure sensor while driving the pump and closing the auxiliary air control valve is smaller than a predetermined value, an abnormality in the second air control valve is detected based on a pressure pulsation in the joint portion in a state where the two air control valves are opened at different timings while driving the pump and opening the auxiliary air control valve, and the first air control valve is closed and the second air control valve is opened, which has been brought by extending a timing for closing the second air control valve.

12. The secondary air supply system according to claim 1, further comprising a pump that is provided on the joint portion of the secondary air supply pipe for supplying secondary air, and an auxiliary air control valve that is provided downstream of the pump for opening and closing the joint portion, the pressure sensor being provided between the pump and the auxiliary air control valve for measuring a pressure in the joint portion such that an abnormality in components of the secondary air supply system is detected based on a pressure value and a pressure change value detected by the pressure sensor, wherein when the pressure change value between the pressure value in the joint portion before opening of the first air control valve and the pressure value in the joint portion after opening of the firstly opened air control valve is smaller than a predetermined value upon opening of the two air control valves at the different timings while driving the pump and opening the auxiliary air control valve, an abnormality in the first air control valve is diagnosed based on a pressure pulsation in the joint portion in a state where the first air control valve is opened and the second air control valve is closed, which has been brought by extending a timing for closing the first air control valve.

13. The secondary air supply system according to claim 1, further comprising a pump that is provided on the joint portion of the secondary air supply pipe for supplying secondary air, and an auxiliary air control valve that is provided downstream of the pump for opening and closing the joint portion, the pressure sensor being provided between the pump and the auxiliary air control valve for measuring a pressure in the joint portion such that an abnormality in components of the secondary air supply system is detected based on a pressure value and a pressure change value detected by the pressure sensor, wherein when a pressure detected by the pressure sensor while driving the pump and closing the auxiliary air control valve is smaller than a predetermined value, an abnormality in the first air control valve is diagnosed based on a pressure pulsation in the joint portion in a state where the two air control valves are opened at different timings while driving the pump and opening the auxiliary air control valve, and the first air control valve is opened and the second air control valve is closed, which has been brought by extending a timing for closing the first air control valve.

14. An abnormality diagnosis method of a secondary air supply system that supplies secondary air to each of exhaust pipes attached to each of two banks of an internal combustion engine via a secondary air supply pipe including a joint portion and two branch portions divided from the joint portion, the secondary air supply system further including two air control valves respectively provided in the two branch portions, and a pressure sensor provided in the joint portion of the secondary air supply pipe, wherein an abnormality diagnosis is executed with respect to the two air control valves which are opened at different timings, the two air control valves including a first air control valve that is firstly opened and a second air control valve that is secondly opened, based on a combination of a fluctuation of a pressure in the joint portion detected by the pressure sensor upon opening of the first air control valves and a fluctuation of a pressure in the joint portion detected by the pressure sensor upon opening of the second air control valve.

15. The abnormality diagnosis method according to claim 14, further comprising opening the second air control valve while holding the first air control valve opened.

16. The abnormality diagnosis method according to claim 15, further comprising inverting a valve opening order for opening the two air control valves in a present cycle of the abnormality diagnosis for a subsequent cycle of the abnormality diagnosis.

17. The abnormality diagnosis method according to claim 15, further comprising when one of the two air control valves is diagnosed as having abnormality in a present cycle of the abnormality diagnosis, opening the air control valve diagnosed as having abnormality firstly in a subsequent cycle of the abnormality diagnosis.

18. The abnormality diagnosis method according to claim 14, further comprising closing the first air control valve upon completion of a measurement of the fluctuation of the pressure upon opening of the first air control valve, and opening the second air control valve thereafter.

19. The abnormality diagnosis method according to claim 18, wherein when at least one of the two air control valves is determined as having abnormality, a type of the abnormality including an open abnormality and a close abnormality is determined based on a result of a comparison between the fluctuation of the pressure detected upon opening of the first air control valve and the fluctuation of the pressure detected upon opening of the second air control valve.

20. The abnormality diagnosis method according to claim 14, wherein it is determined whether the two air control valves are normally operated, the first air control valve has abnormality and the second air control valve is normally operated, the first air control valve is normally operated and the second air control valve has abnormality, and the two air control valves have abnormality, based on a combination of one of absence and presence of the fluctuation of the pressure occurred upon opening of the first air control valve, and one of absence and presence of the fluctuation of the pressure occurred upon opening of the second air control valve.

21. The abnormality diagnosis method according to claim 14, the secondary air supply system further including a pump that is provided on the joint portion of the secondary air supply pipe for supplying secondary air, and an auxiliary air control valve that is provided downstream of the pump for opening and closing the joint portion, the pressure sensor being provided between the pump and the auxiliary air control valve for measuring a pressure in the joint portion such that an abnormality in components of the secondary air supply system is detected based on a pressure value and a pressure change value detected by the pressure sensor, wherein when the pressure change value between the pressure value in the joint portion upon opening of the first air control valve and the pressure value in the joint portion upon opening of the second air control valve is smaller than a predetermined value upon opening of the two air control valves at different timings while driving the pump and opening the auxiliary air control valve, the abnormality in the second air control valve is diagnosed based on a pressure pulsation in the joint portion in a state where the second air control valve is closed and the first air control valve is closed, which has been brought by extending a timing for closing the second air control valve.

22. The abnormality diagnosis method according to claim 14, the secondary air supply system further including a pump that is provided on the joint portion of the secondary air supply pipe for supplying secondary air, and an auxiliary air control valve that is provided downstream of the pump for opening and closing the joint portion, the pressure sensor being provided between the pump and the auxiliary air control valve for measuring a pressure in the joint portion such that an abnormality in components of the secondary air supply system is detected based on a pressure value and a pressure change value detected by the pressure sensor, wherein when a pressure detected by the pressure sensor while driving the pump and closing the auxiliary air control valve is smaller than a predetermined value, an abnormality in the second air control valve is detected based on a pressure pulsation in the joint portion in a state where the two air control valves are opened at different timings while driving the pump and opening the auxiliary air control valve, and the first air control valve is closed and the second air control valve is opened, which has been brought by extending a timing for closing the second air control valve.

23. The abnormality diagnosis method according to claim 14, the secondary air supply system further including a pump that is provided on the joint portion of the secondary air supply pipe for supplying secondary air, and an auxiliary air control valve that is provided downstream of the pump for opening and closing the joint portion, the pressure sensor being provided between the pump and the auxiliary air control valve for measuring a pressure in the joint portion such that an abnormality in components of the secondary air supply system is detected based on a pressure value and a pressure change value detected by the pressure sensor, wherein when the pressure change value between the pressure value in the joint portion before opening of the first air control valve and the pressure value in the joint portion after opening of the firstly opened air control valve is smaller than a predetermined value upon opening of the two air control valves at the different timings while driving the pump and opening the auxiliary air control valve, an abnormality in the first air control valve is diagnosed based on a pressure pulsation in the joint portion in a state where the first air control valve is opened and the second air control valve is closed, which has been brought by extending a timing for closing the first air control valve.

24. The abnormality diagnosis method according to claim 14, the secondary air supply system further including a pump that is provided on the joint portion of the secondary air supply pipe for supplying secondary air, and an auxiliary air control valve that is provided downstream of the pump for opening and closing the joint portion, the pressure sensor being provided between the pump and the auxiliary air control valve for measuring a pressure in the joint portion such that an abnormality in components of the secondary air supply system is detected based on a pressure value and a pressure change value detected by the pressure sensor, wherein when a pressure detected by the pressure sensor while driving the pump and closing the auxiliary air control valve is smaller than a predetermined value, an abnormality in the first air control valve is diagnosed based on a pressure pulsation in the joint portion in a state where the two air control valves are opened at different timings while driving the pump and opening the auxiliary air control valve, and the first air control valve is opened and the second air control valve is closed, which has been brought by extending a timing for closing the first air control valve.

* * * * *